US007252724B2

(12) United States Patent
Tosaka et al.

(10) Patent No.: US 7,252,724 B2
(45) Date of Patent: Aug. 7, 2007

(54) HIGH TENSILE HOT-ROLLED STEEL SHEET HAVING EXCELLENT STRAIN AGING HARDENING PROPERTIES AND METHOD FOR PRODUCING THE SAME

(75) Inventors: Akio Tosaka, Chiba (JP); Sinjiro Kaneko, Chiba (JP); Yoichi Tominaga, Chiba (JP); Noriyuki Katayama, Chiba (JP); Nobutaka Kurosawa, Chiba (JP); Kei Sakata, Chiba (JP); Osamu Furukimi, Chiba (JP)

(73) Assignee: JFE Steel Corporation (JP)

( * ) Notice: Subject to any disclaimer, the term of this patent is extended or adjusted under 35 U.S.C. 154(b) by 424 days.

(21) Appl. No.: 10/643,227

(22) Filed: Aug. 18, 2003

(65) Prior Publication Data

US 2004/0031547 A1 Feb. 19, 2004

Related U.S. Application Data

(62) Division of application No. 09/937,889, filed as application No. PCT/JP01/01005 on Feb. 14, 2001.

(30) Foreign Application Priority Data

Feb. 23, 2000 (JP) ..... 2000-046335
Feb. 29, 2000 (JP) ..... 2000-053439
May 26, 2000 (JP) ..... 2000-156272

(51) Int. Cl.
*C21D 8/02* (2006.01)

(52) U.S. Cl. ..... 148/651; 148/652

(58) Field of Classification Search ..... 148/651, 148/652

See application file for complete search history.

(56) References Cited

U.S. PATENT DOCUMENTS 4,790,889 A 12/1988 Maid et al.

(Continued)

FOREIGN PATENT DOCUMENTS

EP 0 548 950 A1 6/1993

(Continued)

*Primary Examiner*—Sikyin Ip
(74) *Attorney, Agent, or Firm*—DLA Piper US LLP

(57) ABSTRACT

A high tensile strength hot-rolled steel sheet having superior strain aging hardenability, which has high formability and stable quality characteristics, and in which satisfactory strength is obtained when the steel sheet is formed into automotive components, thus enabling the reduction in weight of automobile bodies is provided. Specifically, a method for producing a high tensile strength hot-rolled steel sheet having superior strain aging hardenability with a BH of 80 MPa or more, a ΔTS of 40 MPa or more, and a tensile strength of 440 MPa or more includes the steps of heating a steel slab to 1,000° C. or more, the steel slab containing, in percent by mass 0.15% or less of C, 2.0% or less of Si, 3.0% or less of Mn, 0.08% or less of P, 0.02% or less of S, 0.02% or less of Al, 0.0050% to 0.0250% of N, and optionally 0.1% or less in total of at least one of more than 0.02% to 0.1% of Nb and more than 0.02% to 0.1% of V, the ratio N (mass %)/Al (mass %) being 0.3 or more, rough-rolling the steel slab to form a sheet bar; finish-rolling the sheet bar at a finishing temperature of 800° C. or more; cooling at a cooling rate of 20° C. to 40° C./s or more within 0.5 second after the finish-rolling; and coiling at a temperature of 650° C. to 450° C. or less.

2 Claims, 1 Drawing Sheet

U.S. PATENT DOCUMENTS

| | | | |
|---|---|---|---|
| 5,074,926 | A | 12/1991 | Tosaka et al. |
| 2003/0047256 | A1 | 3/2003 | Kami et al. |
| 2003/0145920 | A1 | 8/2003 | Kami et al. |
| 2003/0188811 | A1 | 10/2003 | Kami et al. |

FOREIGN PATENT DOCUMENTS

| | | | | |
|---|---|---|---|---|
| EP | 0 922 777 | A1 | | 6/1999 |
| EP | 0 940 476 | A1 | | 9/1999 |
| EP | 0 943 696 | A1 | | 9/1999 |
| EP | 0 969 112 | A1 | | 1/2000 |
| EP | 1028167 | A2 | | 8/2000 |
| JP | 55-44551 | A | | 3/1980 |
| JP | 60-145355 | A | | 7/1985 |
| JP | 63-96248 | A | | 4/1988 |
| JP | 4-74824 | A | | 3/1992 |
| JP | 7-30408 | B2 | | 4/1995 |
| JP | 7-316649 | A | | 12/1995 |
| JP | 09104919 | | * | 4/1997 |
| JP | 9-296252 | A | | 11/1997 |
| JP | 10146601 | | * | 6/1998 |
| JP | 10-183301 | A | | 7/1998 |
| JP | 11043725 | | * | 2/1999 |
| JP | 11-279693 | A | | 10/1999 |
| JP | 2000-54071 | A | | 2/2000 |

* cited by examiner

HIGH TENSILE HOT-ROLLED STEEL SHEET HAVING EXCELLENT STRAIN AGING HARDENING PROPERTIES AND METHOD FOR PRODUCING THE SAME

TECHNICAL FIELD

This disclosure relates to high tensile strength hot-rolled steel sheets having superior strain aging hardenability. More particularly, it relates to a high tensile strength hot-rolled steel sheet having a TS (tensile strength) of 440 MPa or more, and relates to a method for producing the same. The high tensile strength hot-rolled steel sheet is mainly used for automobiles as a thin hot-rolled steel sheet having high workability. Furthermore, the high tensile strength hot-rolled steel sheet is used as a replacement for a thin cold-rolled steel sheet having a thickness of approximately 4.0 mm or less and which was employed because it was difficult to produce a steel sheet with such a small thickness by hot rolling. The applications of the steel sheet extend over a wide range from use for relatively light working, such as slight bending and forming of pipes by roll forming, to relatively heavy working, such as drawing by a press.

The disclosure concerns not only hot-rolled steel sheets but also electroplated steel sheets and hot-dip plated steel sheets using the hot-rolled steel sheets as mother plates.

"Having superior strain aging hardenability" means to have the following characteristics:

1) when a steel sheet is subjected to predeformation with a tensile strain of 5% and then aging treatment by retaining the steel sheet at 170° C. for 20 minutes, an increase in deformation stress before and after the aging treatment (hereinafter referred to as BH; BH=Yield stress after aging treatment—Predeformation stress before aging treatment) is 80 MPa or more; and
2) an increase in tensile strength before and after strain aging treatment (the predeformation+the aging treatment) (herein after referred to as ΔTS; ΔTS=Tensile strength after aging treatment—Tensile strength before predeformation) is 40 MPa or more.

BACKGROUND ART

Many thin steel sheets are used as materials for automobile bodies. Cold-rolled steel sheets used to be used for applications in which superior formability is required. However, owing to adjustment of steel compositions (chemical constituents) and optimization of hot rolling conditions, it has become possible to produce hot-rolled steel sheets having high formability (high workability), and therefore, the hot-rolled steel sheets are increasingly used as materials for automobile bodies.

In order to meet restrictions on exhaust gas in view of the global environment, reductions in automobile body weight are very important. In order to reduce the automobile body weight, it is effective to increase the tensile strength of steel sheets and decrease the thickness of the steel sheets. Automotive components to which higher tensile strength and thinner steel sheets are applied must have various characteristics. For example, the required characteristics include static strength to bending and torsional deformation, fatigue strength, and impact resistance. Therefore, the high tensile strength steel sheets used for the automotive components must have such characteristics after formation and working are performed.

On the other hand, press forming is performed to steel sheets when automotive components are manufactured.

Excessively high strength of the steel sheets gives rise to problems; for example, shape fixability is degraded, and defects, such as cracking and necking, are caused during formation due to a decrease in ductility. Such problems have hindered the expansion of the application of high tensile strength steel sheets to automobile bodies.

In order to overcome the difficulties described above, for example, with respect to cold-rolled steel sheets for outer panels, a steel sheet production technique is known in which an ultra low-carbon steel is used as a raw material and the C amount ultimately remaining in the dissolved state is restricted within an appropriate range. In this technique, a strain aging hardening phenomenon, which occurs in a paint baking step performed at 170° C.× approximately 20 minutes after press forming, is used. Shape fixability and ductility are secured during formation by maintaining the softness, and dent resistance is secured after formation by an increase in YS (yield stress) due to strain aging hardening. However, in this technique, in order to avoid stretcher strain leading to surface defects, an amount of the increase in YS cannot be increased sufficiently, and since ΔTS is as small as several Mpa, the thickness of the steel sheet cannot be decreased sufficiently.

On the other hand, in the applications in which appearance is not a great problem, a steel sheet in which the bake hardening amount is further increased by using dissolved N (Japanese Examined Patent Application Publication No. 7-30408), and a steel sheet in which bake hardenability is further improved by using a dual-phase structure composed of ferrite and martensite (Japanese Examined Patent Application Publication No. 8-23048) have been disclosed.

However, in such steel sheets, although a higher bake hardening amount can be obtained because YS (yield stress) is increased to a certain extent after paint baking, it is not possible to increase TS (tensile strength), and no great improvement in fatigue resistance and impact resistance after formation is expected. Therefore, the steel sheets cannot be used for components in which fatigue resistance, impact resistance, etc., are required, which is disadvantageous. Since the amount of the increase in the yield stress YS is unstable, it is not possible to decrease the thickness of the steel sheets in such a way as to contribute to lightening of automotive components, which is also disadvantageous.

Moreover, when a thin steel sheet with a thickness of 2.0 mm or less is produced, since the shape of the steel sheet becomes unsatisfactory in the hot rolling process, it is considerably difficult to press-form the steel sheet.

It would therefore be advantageous to provide a high tensile strength hot-rolled steel sheet having superior strain aging hardenability which overcomes the limitations of the conventional techniques described above, which has high formability and stable quality characteristics, and in which satisfactory strength is obtained when the steel sheet is formed into automotive components, thus greatly contributing to lightening of automobile bodies. It would also be advantageous to provide a method for industrially producing such a steel sheet at low costs and without disturbing the shape thereof.

DISCLOSURE OF INVENTION

In order to solve the problems described above, the present inventors have produced various steel sheets by changing compositions and production methods and have conducted many material evaluation tests. As a result, it has been found that an improvement in formability and an increase in strength after formation are easily made compatible with each other by using N, which has not been used positively in the field where high workability is required, as a strengthening element, and by effectively using a large strain aging hardening phenomenon exhibited by the action of N as the strengthening element. In order to effectively use the strain aging hardening phenomenon by N, the strain aging hardening phenomenon by N must be effectively combined with paint baking conditions for automobiles and heat-treating conditions after formation.

SUMMARY

We produced various steel sheets by changing compositions and production methods and have conducted many material evaluation tests. As a result, it has been found that an improvement in formability and an increase in strength after formation are easily made compatible with each other by using N, which has not been used positively in the field where high workability is required, as a strengthening element, and by effectively using a large strain aging hardening phenomenon exhibited by the action of N as the strengthening element. In order to effectively use the strain aging hardening phenomenon by N, the strain aging hardening phenomenon by N must be effectively combined with paint baking conditions for automobiles and heat-treating conditions after formation. We found that it is effective to adjust the microstructure and the amount of dissolved N in a steel sheet within predetermined ranges by optimizing the hot rolling conditions. It has also been found that in order to stably cause the strain aging hardening phenomenon by N, it is particularly important to control the Al content according to the N content in terms of compositions.

That is, by using N as the strengthening element, by adjusting the content of Al which is a key element in an appropriate range, and by properly setting the hot rolling conditions so that the microstructure and the dissolved N are optimized, it is possible to obtain a steel sheet (steel sheet of the present invention) having significantly superior formability and strain aging hardenability compared to a conventional solid-solution strengthening type C-Mn steel sheet and a precipitation strengthening steel sheet (conventional steel sheets).

In general, in order to evaluate bake hardenability, a tensile test is used. Since large variations in strength occurred when the conventional steel sheets were subjected to plastic deformation under the actual press conditions, the conventional steel sheets could not be applied to components in which high reliability was required even if the conventional steel sheets were evaluated as having desired bake hardenability in the tensile test. In contrast, variations in strength are small when the steel sheet disclosed herein is subjected to plastic deformation under the actual press conditions. Furthermore, the steel sheet disclosed herein has a higher evaluation of bake hardenability according to the tensile test compare to the conventional steel sheets. It has been found that stable component strength characteristics are obtained by using the disclosed steel sheet.

The thin hot-rolled steel sheet used for automobile bodies must have very accurate shape and dimension. It has been found that accuracy of shape and dimension is greatly improved by employing a continuous rolling technique which has recently been put into practical use in the hot rolling process for producing the disclosed steel sheet. Furthermore, it has been found that variations in material properties can be greatly decreased by partially heating or cooling the rolled material so that the temperature profiles in the width direction and in the lengthwise direction become uniform.

Various aspects of the invention have been achieved based on the findings described above and are summarized as follows.

(1) A high tensile strength hot-rolled steel sheet having superior strain aging hardenability contains, in percent by mass, 0.15% or less of C, 2.0% or less of Si, 3.0% or less of Mn, 0.08% or less of P, 0.02% or less of S, 0.02% or less of Al, 0.0050% to 0.0250% of N, and the balance being Fe and incidental impurities, the ratio N (mass %)/Al (mass %) being 0.3 or more, N in the dissolved state being 0.0010% or more.

(2) A high tensile strength hot-rolled steel sheet having superior strain aging hardenability with a tensile strength of 440 MPa or more contains, in percent by mass, 0.15% or less of C, 2.0% or less of Si, 3.0% or less of Mn, 0.08% or less of P, 0.02% or less of S, 0.02% or less of Al, 0.0050% to 0.0250% of N, and the balance being Fe and incidental impurities, the ratio N (mass %)/Al (mass %) being 0.3 or more, N in the dissolved state being 0.0010% or more, and also has a structure in which the areal rate of the ferrite phase having an average grain size of 10 μm or less is 50% or more.

(3) A steel sheet according to (2) further contains at least one selected from the group consisting of the following Group a to Group d:

Group a: 1.0% or less in total of at least one of Cu, Ni, Cr, and Mo

Group b: 0.1% or less in total of at least one of Nb, Ti, and V

Group c: 0.0030% or less of B

Group d: 0.0010% to 0.010% in total of at least one of Ca and REM.

(4) A steel sheet according to either (2) or (3), wherein the thickness of the high tensile strength hot-rolled sheet is 4.0 mm or less.

(5) A high tensile strength hot-rolled plated steel sheet produced by electroplating or hot-dip plating a steel sheet according to any one of (2) to (4).

(6) A method for producing a high tensile strength hot-rolled steel sheet having superior strain aging hardenability with a tensile strength of 440 MPa or more includes the steps of heating a steel slab to 1,000° C. or more, the steel slab containing, in percent by mass, 0.15% or less of C, 2.0% or less of Si, 3.0% or less of Mn, 0.08% or less of P, 0.02% or less of S, 0.02% or less of Al, 0.0050% to 0.0250% of N, and optionally further containing at least one selected from the group consisting of the following Group a to Group d, the ratio N (mass %)/Al (mass %) being 0.3 or more; rough-rolling the steel slab to form a sheet bar; finish-rolling the sheet bar at a finishing temperature of 800° C. or more; cooling at a cooling rate of 20° C./s or more within 0.5 second after the finish-rolling; and coiling at a temperature of 650° C. or less:

Group a: 1.0% or less in total of at least one of Cu, Ni, Cr, and Mo

Group b: 0.1% or less in total of at least one of Nb, Ti, and V

Group c: 0.0030% or less of B

Group d: 0.0010% to 0.010% in total of at least one of Ca and REM.

(7) A method according to (6) further includes the step of performing at least one of skin pass rolling and leveling with an elongation of 1.5% to 10% after the coiling step is performed.

(8) A method according to either (6) or (7) further includes the step of joining consecutive sheet bars to each other between the steps of rough-rolling and finish-rolling.

(9) A method according to any one of (6) to (8) further includes the step of using at least one of a sheet bar edge heater for heating a widthwise end of the sheet bar and a sheet bar heater for heating a lengthwise end of the sheet bar between the steps of rough-rolling and finish-rolling.

(10) A high tensile strength hot-rolled steel sheet having superior strain aging hardenability with a BH of 80 MPa or more, a ΔTS of 40 MPa or more, and a tensile strength of 440 MPa or more contains, in percent by mass, 0.15% or less of C, 2.0% or less of Si, 3.0% or less of Mn, 0.08% or less of P, 0.02% or less of S, 0.02% or less of Al, 0.0050% to 0.0250% of N, and the balance being Fe and incidental impurities, the ratio N (mass %)/Al (mass %) being 0.3 or more, N in the dissolved state being 0.0010% or more, and also has a structure in which the areal rate of the ferrite phase having an average grain size of 10 μm or less is 70% or more, and the areal rate of the martensite phase is 5% or more.

(11) A method for producing a high tensile strength hot-rolled steel sheet having superior strain aging hardenability with a BH of 80 MPa or more, a ΔTS of 40 MPa or more, and a tensile strength of 440 MPa or more includes the steps of heating a steel slab to 1,000° C. or more, the steel slab containing, in percent by mass, 0.15% or less of C, 2.0% or less of Si, 3.0% or less of Mn, 0.08% or less of P, 0.02% or less of S, 0.02% or less of Al, 0.0050% to 0.0250% of N, and optionally further containing at least one selected from the group consisting of the following Group a to Group d, the ratio N (mass %)/Al (mass %) being 0.3 or more; rough-rolling the steel slab to form a sheet bar; finish-rolling the sheet bar at a finishing temperature of 800° C. or more; cooling at a cooling rate of 20° C./s or more within 0.5 second after the finish-rolling; and coiling at a temperature of 450° C. or less:

Group a: 1.0% or less in total of at least one of Cu, Ni, Cr, and Mo

Group b: 0.1% or less in total of at least one of Nb, Ti, and V

Group c: 0.0030% or less of B

Group d: 0.0010% to 0.010% in total of at least one of Ca and REM.

(12) A high tensile strength hot-rolled steel sheet having superior strain aging hardenability contains, in percent by mass, 0.03% to 0.1% of C, 2.0% or less of Si, 1.0% to 3.0% of Mn, 0.08% or less of P, 0.02% or less of S, 0.02% or less of Al, 0.0050% to 0.0250% of N, 0.1% or less in total of at least one of more than 0.02% to 0.1% of Nb and more than 0.02% to 0.1% of V, and the balance being Fe and incidental impurities, the ratio N (mass %)/Al (mass %) being 0.3 or more, N in the dissolved state being 0.0010% or more, the total of precipitated Nb and precipitated V being 0.015% or more, and also has a structure in which the areal rate of the ferrite phase having an average grain size of 10 μm or less is 80% or more, and the average grain size of a precipitate composed of a Nb carbonitride or a V carbonitride is 0.05 μm or less.

(13) A method for producing a high tensile strength hot-rolled steel sheet having superior strain aging hardenability includes the steps of heating a steel slab to 1,100° C. or more, the steel slab containing, in percent by mass, 0.03% to 0.1% of C, 2.0% or less of Si, 1.0% to 3.0% of Mn, 0.08% or less of P, 0.02% or less of S, 0.02% or less of Al, 0.0050% to 0.0250% of N, 0.1% or less in total of at least one of more than 0.02% to 0.1% of Nb and more than 0.02% to 0.1% of V, and the balance being Fe and incidental impurities; rough-rolling the steel slab to form a sheet bar; finish-rolling the sheet bar at a finishing temperature of 800° C. or more; cooling at a cooling rate of 40° C./s or more within 0.5 second after the finish-rolling; and coiling in the temperature range of 550 to 650° C.

DETAILED DESCRIPTION

Figure 1:
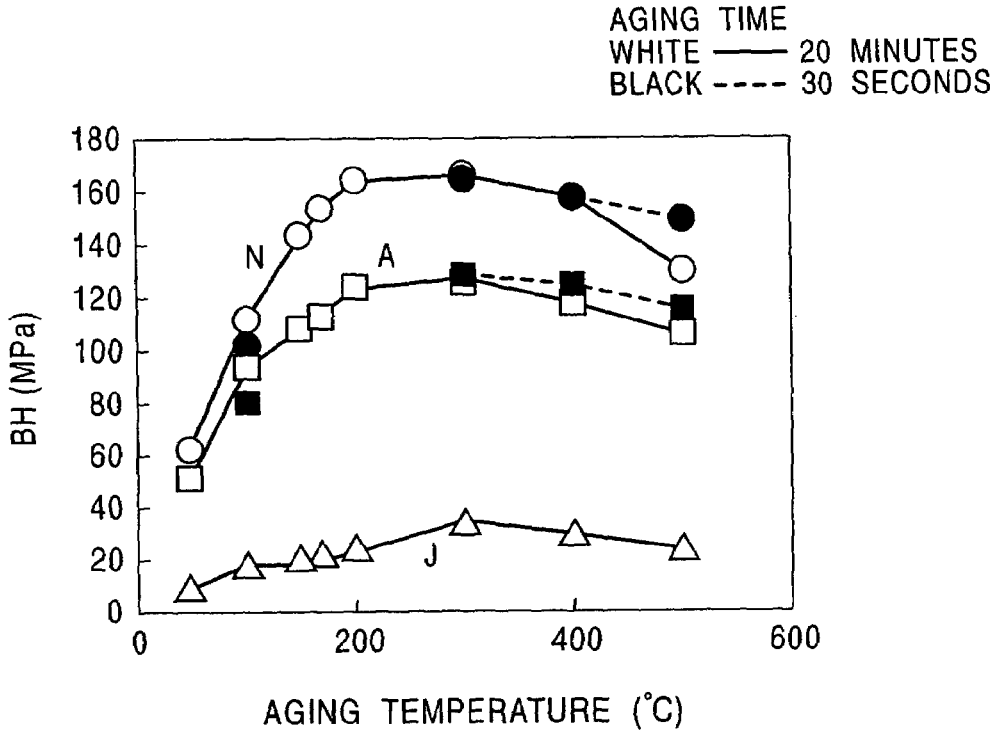
FIG. 1 is a graph which shows BH (an increase in deformation stress) with respect to examples of disclosed steel sheets and comparative examples.

First, the chemical compositions of disclosed steels will be described. The content (%) of each constituent element is shown in percent by mass.

C: 0.15% or less

C is an element which increases the strength of steel sheets, and in order to ensure desired strength, the C content is preferably set at 0.005% or more. The C content is also preferably set at 0.005% or more in order to suppress grain coarsening. If the C content exceeds 0.15%, the following problems arise. (1) Since the percentage of carbides in steel becomes excessive and the ductility of steel sheets is greatly decreased, formability is degraded. (2) Spot weldability and arc weldability are greatly degraded. (3) With respect to hot rolling of a steel sheet with a large width and a small thickness, deformation resistance greatly increases below the austenite low temperature range, and the rolling force rises suddenly, resulting in a difficulty in rolling. Therefore, the C content is set at 0.15% or less. Additionally, in view of an improvement in formability, the C content is preferably 0.08% or less, and in applications where good ductility is particularly important, the C content is more preferably 0.05% or less.

However, with respect to a steel sheet of the present invention containing 0.1% or less in total of at least one of more than 0.02% to 0.1% of Nb and more than 0.02% to 0.1% of V, the C content is preferably set at 0.03% to 0.1%. C is an element which increases the strength of steel sheets and ensures desired strength by formation of carbonitrides with Nb and V (precipitates), and thus the C content is preferably set at 0.03% or more. In order to suppress grain coarsening, preferably, the C content is also set at 0.03% or more. On the other hand, as will be described below, in order to finely precipitate carbonitrides of Nb and V, after hot rolling is completed, the carbonitrides must be precipitated in the low-temperature ferrite phase. If the C content exceeds 0.1% at this stage, coarse carbonitrides are formed during hot rolling, resulting in a decrease in the strength of the steel sheet. Therefore, the C content is set at 0.1% or less.

Si: 2.0% or less

Si is an effective element which increases the strength of steel sheets without greatly decreasing the ductility of steel. On the other hand, since Si greatly increases the $Ar_3$ transformation temperature, a large amount of the ferrite phase tends to be generated during finish rolling. Si also adversely affects steel sheets, for example, degrading of surface properties and glossy surface. In order to obtain the strength-increasing effect significantly, the Si content is preferably set at 0.1% or more. If the Si content is 2.0% or less, it is possible to inhibit a large increase of the transformation temperature by adjusting the amount of Mn which is added to steel in combination with Si, and satisfactory surface properties are also ensured. Therefore, the Si content is set at 2.0% or less. Additionally, in order to ensure high ductility with a TS of more than 500 MPa, in view of the balance between strength and ductility, the Si content is preferably set at 0.3% or more.

Mn: 3.0% or less

Mn decreases the $Ar_3$ transformation temperature, and it is possible to make Mn counter the action of Si for increasing the transformation temperature. Mn is an element which is effective in preventing hot brittleness due to S, and in view of preventing hot brittleness, Mn is preferably added according to the amount of S. Since Mn has a grain refining effect, it is desirable that Mn be actively added so that Mn is used for improving material properties. In view of stably fixing S, the Mn content is preferably set at approximately 0.2% or more, and in order to meet the strength requirement of TS 500 MPa class, the Mn content is preferably set at 1.2% or more, and more preferably, at 1.5% or more. By increasing the Mn content to such a level, variations of mechanical properties and strain aging hardenability of steel sheets are reduced with respect to the change in hot rolling conditions, thus being effective in stabilizing the quality.

However, if the Mn content exceeds 3.0%, the following problems arise. (1) Although the detailed mechanism is unknown, the deformation resistance at elevated temperatures of steel sheets tends to be increased. (2) Weldability and formability at the welding zone tend to be degraded. (3) Since the generation of ferrite is greatly suppressed, ductility is degraded. Therefore, the Mn content is preferably limited to 3.0% or less. Additionally, in applications where more satisfactory corrosion resistance and formability are required, the Mn content is preferably set at 2.5% or less.

With respect to a product with particularly small thickness, since the quality and shape are minutely changed due to the variation of the transformation temperature, it is important to more strictly balance between the action of Mn for decreasing the transformation temperature and the action of Si for increasing the transformation temperature. From such a viewpoint, in the steel sheet used for automobile bodies with a thickness of approximately 4.0 mm or less, the ratio Mn/Si (ratio between the Mn amount and the Si amount) is preferably set at 3 or more.

However, with respect to a steel sheet containing 0.1% or less in total of at least one of more than 0.02% to 0.1% of Nb and more than 0.02% to 0.1% of V, the Mn content is preferably set at 1.0% to 3.0%. If the Mn content is less than 1.0%, the $Ar_3$ transformation temperature increases, and carbonitrides are remarkably formed in the high-temperature ferrite phase, and since the carbonitrides coarsen, it becomes difficult to ensure desired strength. Therefore, the Mn content must be 1.0% or more.

P: 0.08% or less

Although P is effective as a solid-solution strengthening element, if the P content is excessive, steel is embrittled and the stretch-flanging property of the steel sheet is degraded. P also tends to segregate in steel, resulting in embrittlement at the welding zone. Therefore, the P content is set at 0.08% or less. Additionally, when the stretch-flanging property and toughness at the welding zone are regarded as particularly important, the P content is preferably set at 0.04% or less.

S: 0.02% or less

S is an element which is present as an inclusion, degrades the ductility of the steel sheet, and also degrades the corrosion resistance. Therefore, the S content is limited to 0.02% or less. In applications where particularly good workability is required, the S content is preferably set at 0.015%. When the required level of the stretch-flanging property, which is particularly susceptible to the S amount, is high, the S content is preferably 0.008% or less. Although the detailed mechanism is unknown, if the S content is decreased to 0.008% or less, the strain aging hardenability of the hot-rolled steel sheet tends to be stabilized at a higher level. For this reason, the S content is also preferably 0.008% or less.

Al: 0.02% or less

Al is added to steel as a deoxidizing element, which is effective in improving the cleanness of the steel, and Al is also preferably added to the steel in order to achieve texture refinement. However, if the Al content is excessive, the following problems arise. (1) The surface properties of steel sheets are degraded. (2) The amount of dissolved, which is important, is decreased. (3) Even if dissolved N is ensured, if the Al content exceeds 0.02%, variations in strain aging hardenability due to the change in production conditions are increased. Therefore, the Al content is limited to 0.02% or less. Additionally, in view of material stability, the Al content is more preferably set at 0.001% to 0.016%.

N: 0.0050% to 0.0250%

N is the most important constituent element. That is, by the addition of an appropriate amount of N to control the production conditions, it is possible to secure a necessary and sufficient amount of N in the dissolved state in the mother plate (as hot rolled). Thereby, the effect of an increase in strength (YS, TS) due to solid-solution strengthening and strain aging hardening is satisfactorily exhibited, and it is possible to stably satisfy the mechanical property conditions of the steel sheet, i.e., TS of 440 MPa or more, BH of 80 MPa or more, and ΔTS of 40 MPa or more. N also decreases the $Ar_3$ transformation temperature. Since it is possible to prevent a thin steel sheet, whose temperature is easily decreased during hot rolling, from being rolled at a temperature lower than the $Ar_3$ transformation temperature, N is effective in stabilizing operation.

If the N content is less than 0.0050%, it is not possible to obtain the strength-increasing effect. On the other hand, if the N content exceeds 0.0250%, the rate of occurrence of internal defects of the steel sheet increases, and also slab cracking during continuous casting, etc., often occurs. Therefore, the N content is set at 0.0050% to 0.0250%. In view of material stability and improvements in yield in consideration of the whole manufacturing process, the N content is preferably set at 0.0070% to 0.0170%. Additionally, if the N content is in that range, there are no adverse effects on weldability.

Even if N is added, if the N content is in the disclosed range, there is substantially no increase in deformation resistance at elevated temperatures during the production of steel sheets. It has been found that use of strengthening due to N is significantly advantageous to the production of high tensile strength thin hot-rolled steel sheets.

N in the dissolved state: 0.0010% or more

In order to ensure sufficient strength in the mother plate and to exhibit satisfactory strain aging hardenability due to N, i.e., to set the BH at 80 MPa or more and the ΔTS at 40 MPa or more, 0.0010% or more of N in the dissolved state (hereinafter referred to as "dissolved N") must be present in steel. Herein, the amount of dissolved N is found by subtracting the amount of precipitated N from the total amount of N in steel. As a method for extracting precipitated N, i.e., as a method for dissolving ferrite, an acidolysis, a halogen process, or an electrolytic process may be used. As a result of comparative study among these methods for dissolving ferrite, we found that the electrolytic process is most superior. In the electrolytic process, only ferrite can be stably dissolved without decomposing significantly unstable precipitates, such as carbides and nitrides. Accordingly, precipitated N is extracted by dissolving ferrite using the electrolytic process. As an electrolytic solution, an acetylacetone-based solution is used, and electrolysis is performed at a constant potential. The residue extracted by the electrolytic process is chemically analyzed to find the N amount in the residue, which is defined as the amount of precipitated N.

Additionally, in order to achieve large BH and ΔTS, the amount of dissolved N is preferably set at 0.0020% or more, and in order to achieve larger BH and ΔTS, the amount of dissolved N is preferably set at 0.0030% or more.

N/Al (ratio between the N amount and the Al amount): 0.3 or more

As described above, in order to keep 0.0010% or more of dissolved N stably without being affected by the production conditions, the amount of Al, which is an element for strongly fixing N, must be limited to 0.02% or less. As a result of searching for the conditions in which the amount of dissolved N after hot rolling is 0.0010% or more with respect to steels in which the combination of the N amount and the Al amount is widely changed within the compositional range, it has been found that the ratio N/Al must be 0.3 or more. Furthermore, cooling conditions and the coiling temperature condition after finish-rolling must be set in the ranges described below. Therefore, the Al amount is limited N/0.3 or less.

Group a: 1.0% or less in total of at least one of Cu, Ni, Cr, and Mo

Since all of the elements Cu, Ni, Cr, and Mo in Group a contribute to an increase in the strength of steel sheets, they may be added alone or in combination. However, if it is an excessive amount, deformation resistance at elevated temperatures is increased, chemical conversion properties and surface treatment properties in a broad sense are degraded, formability at the welding zone is degraded due to hardening of the welding zone, and so on. Therefore, the total amount of Group a is preferably 1.0% or less.

Group b: 0.1% or less in total of Nb, Ti, and V

Since all of the elements Nb, Ti, and V in Group b contribute to refinement and uniformization of the grain size, they may be added alone or in combination. However, if the amount is excessive, deformation resistance at elevated temperatures is increased, chemical conversion properties and surface treatment properties in a broad sense, such as paintability, are degraded, formability at the welding zone is degraded due to hardening of the welding zone, and so on. Therefore, the total amount of Group b is preferably 0.1% or less.

Group c: 0.0030% or less of B

The element B in Group c improve the hardenability of steel. B is appropriately added to steel in order to increase the strength of the steel by changing the structure phases other than ferrite to low-temperature transformation phases. However, if the amount is excessive, since B precipitates as BN, it is not possible to secure the dissolved N. Therefore, the B content must be limited to 0.0030% or less.

Group d: 0.0010% to 0.010% in total of at least one of Ca and REM

The elements Ca and REM in Group d control the shapes of inclusions, and, in particular, when the stretch-flanging property is required, they are added alone or in combination. In such a case, if the total amount is less than 0.0010%, the control effect is insufficient. On the other hand, if the total amount exceeds 0.010%, the occurrence of surface defects becomes conspicuous. Therefore, the total amount of Group d to be added is preferably set in the range of 0.0010% to 0.010%.

When Nb and V are added, preferably, 0.1% in total of at least one or more than 0.02% to 0.1% of Nb and more than 0.02% to 0.1% of V is contained.

Nb and V are important constituent elements. By adding appropriate amounts of Nb and V and by controlling the production conditions as described below, it is possible to form an appropriate amount of significantly fine carbonitrides, and desired strength is ensured and the yield ratio can be greatly increased. Thereby, fatigue resistance and impact resistance are remarkably improved. Furthermore, the fine carbonitrides of Nb and V improve the strain aging hardenability and contribute to refinement and uniformization of the ferrite grain size. If the content of Nb or V (i.e., the concentration of the additive constituent in steel) is 0.02% or less, the effect thereof is small, and therefore, the content of Nb or V is set at more than 0.02%.

On the other hand, the content of Nb and V (total content when both elements are added in combination) exceeding 0.1% gives rise to problems; for example, (1) an increase in deformation resistance at elevated temperatures, (2) degradation of chemical conversion properties and surface treatment properties, such as paintability, and (3) degradation of formability at the welding zone due to hardening at the welding zone. Therefore, the content of Nb and V (total content when both elements are added in combination) is set at 0.1% or less.

Total amount of precipitated Nb and precipitated V: 0.015% or more

Nb and V are precipitated as fine carbonitrides, thus increasing strength and improving strain aging hardenability. If the amount of Nb or V present as carbonitrides, or the total amount of these when Nb and V are added in combination, is less than 0.015%, the strength increasing effect and the strain aging hardenability improving effect are not exhibited sufficiently. In the composition of steel of the present invention, since substantially all the precipitation of Nb and V are precipitated as carbonitrides, the amount of Nb and the amount of V present as carbonitrides of Nb and V are determined by measuring the amount of precipitated Nb and the amount of precipitated V, respectively. Therefore, the total amount of precipitated Nb and precipitated V is limited to 0.015% or more. Herein, in order to measure the amount of precipitated Nb and the amount of precipitated V, extraction is performed by the electrolysis process described above, and the amount of Nb and the amount of V in the residue are determined as precipitated Nb and precipitated V.

Next, the structure and mechanical properties of steel sheets will be described.

Areal Rate of Ferrite Phase:

Steel sheets used for automobiles must have satisfactory workability. In order to ensure ductility necessary as steel sheets used for automobiles, the areal rate of the ferrite phase is preferably 50% or more.

Additionally, when high strength is required, the areal rate of the ferrite phase is set at less than 50%, and the areal rate of the bainite phase or the martensite phase is set at 35% or more, or the total areal rate thereof is set at 35% or more. By using such a structural composition, the steel sheet having a tensile strength of 780 Mpa or more, as steel sheet tensile characteristics, is easily obtained. In such a case, the steel sheet is preferably applied to a section in which an emphasis is placed on strength rather than on ductility in the automotive application.

When satisfactory ductility is required, the areal rate of the ferrite phase is preferably set at 70% or more, and when more satisfactory ductility is required, the areal rate of the ferrite phase is more preferably set at 80% or more. Herein, examples of ferrite also include bainitic ferrite and acicular ferrite which do not contain carbides, in addition to so-called ferrite (polygonal ferrite).

Additionally, although phases other than the ferrite phase are not specifically limited, in view of increasing strength, each single phase of bainite, martensite, and retained austenite or a mixed phase thereof is preferred.

Average Grain Size of Ferrite Phase: 10 μm or less

The average grain size is determined by the value which is larger when compared between the value measured by mensuration according to ASTM based on a photograph of the sectional structure and the nominal grain size measured by an intercept method (for example, refer to "Thermal Treatment" 24 (1984) 334 by Umemoto, et al.).

Although dissolved N is secured in the mother plate, according to our experiment and analysis results, even if the amount of dissolved N is kept at a certain level, if the average grain size of the ferrite phase exceeds 10 μm, variations in strain aging hardenability are increased. Although the detailed mechanism for the above is unknown, the segregation and precipitation of alloying elements in the grain boundaries, and working and heat treatment applied thereto are considered to be related to the variations. Independent of the reasons, in order to stabilize strain aging hardenability, the average grain size of the ferrite phase must be set at 10 μm or less. Additionally, in order to further improve and stabilize BL and ΔTS, the average grain size is preferably set at 8 μm or less.

When the martensite phase (M phase) is contained in the structure, the areal rate of the M phase is preferably 5% or more. The M phase contained in the structure at the areal rate of 5% or more is effective in the present invention. Thereby, the steel sheet has satisfactory ductility in spite of high strength and high BH and ΔTS. If the areal rate of the M phase is less than 5%, the effect thereof is not obtained sufficiently. Due to the presence of the martensite phase at the areal rate of 5% or more, in addition to the improvement in ductility, the yield ratio=YS/TS is decreased, and the shape fixability improving effect is remarkably exhibited particularly when working is performed in the minute strain range.

In view of ductility and the low yield ratio, the areal rate of the M phase is preferably less than 35%, and more preferably, 7% to 20%. In such a case, in the steel sheet, in addition to ferrite and martensite, the bainite phase, the pearlite phase, etc. may be contained in the structure if the areal rate thereof is several percent.

On the other hand, in view of an increase in strength, the areal rate of the M phase is preferably 35% or more, or the total area rate of the M phase and the bainite phase is preferably 35% or more. In such a case, the structure may contain the pearlite phase and the retained austenite phase at the areal rate of several percent, in addition to the ferrite, bainite, and martensite phases.

When Nb and V are added, the average grain size of the precipitate comprising Nb or V carbonitrides is preferably 0.05 μm or less. In order for the carbonitrides of Nb or V to increase strength and to improve strain aging hardenability, the carbonitrides must be precipitated finely. If the average grain size of the carbonitrides is coarser than 0.05 μm, the effects thereof are not exhibited. Therefore, the average grain size of the carbonitrides is set at 0.05 μm or less.

Additionally, in order to measure the grain size of the carbonitrides of Nb and V, at least 20 visual fields are observed by a transmission electron microscope with a magnifying power of 100,000 using thin films. With respect to the precipitates observed, carbonitrides of Nb and V are identified using an energy-dispersive X-ray analyzer (EDX). The grain size is defined as ½ of the sum of the determined breadth and length of the carbonitride of Nb and V. The grain size is measured for all the carbonitrides of Nb and V in the visual field, and the average of the total sum is defined as the average grain size.

Tensile Strength (TS): 440 MPa or more

A steel sheet used for structural members of automobile bodies must have a TS of 440 MPa or more. A steel sheet used for structural members in which further strength is required must have a TS of 540 MPa or more.

Strain Aging Hardenability

As described above, "having superior strain aging hardenability" means to have the following characteristics:

1) when a steel sheet is subjected to predeformation with a tensile strain of 5% and then aging treatment by retaining the steel sheet at 170° C. for 20 minutes, an increase in deformation stress before and after the aging treatment (hereinafter referred to as BH; BH=Yield stress after aging treatment—Predeformation stress before aging treatment) is 80 MPa or more; and
2) an increase in tensile strength before and after strain aging treatment (the predeformation+the aging treatment) (herein after referred to as ΔTS; ΔTS=Tensile strength after aging treatment—Tensile strength before predeformation) is 40 MPa or more.

Predeformation with a Tensile Strain of 5%

When strain aging hardenability is defined, a prestrain (predeformation) is an important factor. We have studied the influence of the prestrain on strain aging hardenability, assuming the deformation mode applied to steel sheets used for automobiles. As a result, it has been found that (1) the deformation stress in the deformation mode described above can be substantially integrated into a uniaxial stress (tensile strain) except for extremely deep drawing; (2) in a real component, the uniaxial stress generally exceeds 5%; and (3) component strength (strength of a real component) well corresponds to the strength obtained after strain aging treatment with a prestrain of 5% is performed. Based on the knowledge described above, the predeformation for the strain aging treatment is defined as a tensile strain of 5%.

Aging Treatment Conditions: (Heating Temperature) 170° C.×(Retention Time) 20 minutes In the conventional paint baking treatment conditions, 170° C.×20 minutes is adopted as the standard. Therefore, 170° C.×20 minutes is defined as the aging treatment conditions. Additionally, when a strain of 5% or more is applied to a steel sheet of the present invention containing a large amount of dissolved N, hardening is performed by treatment at a lower temperature. In other words, the aging conditions may be set more widely. In general, in order to increase the amount of hardening, retention at a higher temperature for a longer time is advantageous as long as softening is prevented.

Specifically, the lower limit of the heating temperature in which hardening is noticeable after preformation is approximately 100° C. On the other hand, if the heating temperature exceeds 300° C., hardening hits the peak, and if the heating temperature is 400° C. or more, a tendency toward slightly softening appears, and also thermal strain and temper color become conspicuous. As for the retention time, hardening is satisfactorily achieved if the retention time is set at approximately 30 seconds at a heating temperature of approximately 200° C. In order to achieve the larger amount of hardening and stable hardening, the retention time is preferably set at 60 seconds or more. However, even if retention is performed for more than 20 minutes, no further hardening is achieved, and production efficiency is reduced, resulting in no practical benefits.

For the reasons described above, after working is performed, preferably, the heating temperature is set at 100 to 300° C. and the retention time is set at 30 seconds to 20 minutes as the aging treatment conditions. Even under the aging conditions of low-temperature heating and short-time retention in which sufficient hardening is not achieved in the conventional paint baking type steel sheet, a large amount of hardening can be obtained. Additionally, the method for heating is not specifically limited, and in addition to atmospheric heating using a furnace which is employed for general paint baking, induction heating, heating by non-oxidizing flame, laser beam, or plasma, or the like may be preferably used.

H: 80 MPa or more, ΔTS: 40 MPa or more

Automobile components must have strength which can cope with complex stress loading from outside. Therefore, it is important for the material steel sheet to have a strength characteristic in the small strain range as well as a strength characteristic in the large strain range. From this viewpoint, We have limited BH to 80 MPa or more and TS to 40 MPa or more with respect to the steel sheet of the present invention to be used as material for automobile components. More preferably, BH is set at 100 MPa or more and ΔTS is set at 50 MPa or more. It is understood that the above limitations define BH and ΔTS under the conditions of aging treatment of 170° C.×20 minutes after a prestrain of 5% is applied. BH and ΔTS may be increased also by setting the heating temperature higher and/or by setting the retention time longer.

In the steel sheet, even if accelerated aging by heating (artificial heating) is not performed after forming and working, only by leaving the steel sheet at room temperature, an increase in strength corresponding to at least approximately 40% of full aging is expected. Moreover, on the other hand, in the state in which forming and working are not performed, even if the steel sheet is left at room temperature for a long time, aging degradation, i.e., a phenomenon in which YS increases and El (elongation) decreases, does not occur, which is a superior characteristic not observed in the known art.

When the thickness of the produced steel sheet exceeds 4.0 mm, the advantages are lost because even the conventional steel sheet having large deformation resistance at elevated temperatures can be easily hot-rolled and because steel sheets having a thickness of more than 4.0 mm are not substantially used for automobiles. Therefore, the steel sheet preferably has a thickness of 4.0 mm or less.

A plated steel sheet obtained by electroplating or hot-dip plating the steel sheet also has TS, BH, and ΔTS which are substantially the same as those before plating. As the type of plating, any one of electro-galvanizing, hot-dip galvanizing, hot-dip galvannealing, electrotinning, electrolytic chromium plating, and electrolytic nickel plating may be preferably used.

Next, the method for producing the steel sheet will be described.

The steel sheet is produced basically by a hot-rolling process in which a steel slab having the composition within the disclosed ranges is heated, the steel slab is rough-rolled to form a sheet bar, the sheet bar is finish-rolled, and coiling is performed after cooling. Although the slab is preferably formed by continuous casting in order to avoid macroscopic segregation of constituents, the slab may be formed by an ingot-making method, or a thin slab continuous casting method. Instead of the ordinary process in which the produced slab is cooled to room temperature and heating is performed again, an energy-saving process, such as a process in which a hot slab without cooling is inserted into a furnace or a direct rolling process in which a produced slab is directly rolled after slight retention of heat, may be used. In particular, in order to efficiently secure N in the dissolved state, direct rolling is one of the effective techniques.

Hot-rolling conditions are defined as follows.

Slab Heating Temperature: 1,000° C. or more

In order to secure the initial amount of dissolved N and to meet the target (0.0010% or more) of dissolved N in the product, the slab heating temperature (hereinafter referred to as "SRT") is set at 1,000° C. or more. Additionally, in order to avoid an increase in loss due to oxidation weight gain, the SRT is preferably 1,280° C. or less. Rough-rolling of the heated slab may be performed in a known method.

After rough-rolling is performed, the sheet bar is subjected to finish-rolling. Finish-rolling is preferably performed continuously by joining consecutive sheet bars to each other between rough-rolling and finish-rolling. As the joining means, fusion-pressure welding, laser beam welding, electron beam welding, or the like may be appropriately used.

Thereby, the proportion of non-steady sections (front ends and back ends of the processed member) in which the shape is easily disturbed during finish-rolling and subsequent cooling is decreased, and the stable rolling length (the continuous length which can be rolled under the same conditions) and the stable cooling length (the continuous length which can be cooled under tension) are extended, and thereby accuracy of shape and dimension and the yield of the product are improved. Lubrication-rolling, which was difficult to perform due to stability in continuous rolling and biting properties in the conventional single-shot rolling for each sheet bar, can be easily performed to thin, wide sheet bars, and the rolling force and the bearing stress are reduced, resulting in an extension of the roller life.

Preferably, at least one of a sheet bar edge heater for heating a widthwise end of the sheet bar and a sheet bar heater for heating a lengthwise end of the sheet bar is used between the steps of rough-rolling and finish-rolling so that the temperature profiles in the width direction and in the lengthwise direction becomes uniform. Thereby, the variations in material properties within the steel sheet can be further decreased. A sheet bar edge heater or sheet bar heater of induction heating type is preferably used.

First, the temperature variation in the width direction is compensated for by the sheet bar edge heater. At this stage, heating is preferably adjusted so that the temperature range in the width direction at the finishing side in finish-rolling is within approximately 20° C., although it depends on the steel composition, etc. Next, the temperature variation in the longitudinal direction is compensated for by the sheet bar heater. At this stage, heating is preferably adjusted so that the temperature in the lengthwise end is higher than the temperature in the center by approximately 20° C.

Finishing Temperature in Finish-rolling: 800° C. or more

In finish-rolling, in order to adjust the texture of the steel sheet uniformly and finely, the finishing temperature in finish-rolling (hereinafter referred to as "FDT") is set at 800° C. or more. If the FDT is less than 800° C., the finish-rolling temperature is too low and the texture becomes nonuniform, and deformation textures partially remain, which may result in various problems during press forming. Although the remaining of such deformation textures may be avoided by high-temperature coiling, if high-temperature coiling is performed, coarse grains are generated and strength is decreased, and also the amount of dissolved N is also greatly decreased. Therefore, it becomes difficult to obtain a target TS of 440 MPa. Additionally, in order to further improve the mechanical properties, the FDT is preferably set at 820° C. or more.

In finish-rolling, to perform lubrication-rolling to reduce the load during hot-rolling is effective in uniformizing the shape and material properties. In such a case, the coefficient of friction is preferably in the range of 0.25 to 0.10, and it is desirable that the lubrication-rolling be performed in combination with the continuous rolling in view of the operational stability in hot-rolling.

Cooling after Rolling: Water-cooling at a cooling rate of 20° C./s or more started within 0.5 second after rolling After rolling is completed, cooling is started immediately (within approximately 0.5 second), and the cooling must be performed rapidly at an average cooling rate of 20° C./s or more. If these conditions are not satisfied, since grains grow excessively, refinement of the grain size is not achieved, and also, since AlN precipitates excessively due to strain energy introduced by rolling, the amount of dissolved N becomes insufficient. Additionally, in order to ensure uniformity in the material properties and shape, the average cooling rate is preferably set at 300° C./s or less.

With respect to the cooling pattern when the M phase is contained in the structure at the areal rate of 5% or more, cooling may be performed continuously as is usually done, or in order to control the $\gamma$ to $\alpha$ transformation during cooling and to achieve the phase separation in the structure advantageously, it is also effective to perform slow cooling (interruption of rapid cooling) for approximately 1 to 5 seconds at a rate of 10° C./s or less in the temperature range of 700 to 800° C. However, after the slow cooling, rapid cooling must be performed again at a rate of 20° C./s or more.

Coiling Temperature: 650° C. or less

As the coiling temperature (hereinafter referred to as "CT") decreases, the strength of the steel sheet increases, and in order to achieve the target TS of 440 MPa or more at CT 650° C. or less, the CT is set at 650° C. or less. Additionally, if the CT is less than 200° C., the shape of the steel sheet is easily disturbed and problems may arise in practical use, and therefore, CT is preferably 200° C. or more. In view of material uniformity, CT is preferably 300° C. or more, and more preferably, more than 450° C.

When the M phase is contained in the structure at the areal rate of 5% or more, the coiling temperature is preferably set to 450° C. or less. The strength of the steel sheet increases as the coiling temperature decreases. At a CT of 450° C. or less, the texture is refined and the areal rate of the M phase reaches 5% or more, and thereby the target TS of 440 MPa or more is achieved. Therefore, the CT is set at 450° C. or less. Furthermore, in order to obtain the M phase stably, 40° C./s or more is preferable. Additionally, if the CT is less than 100° C., the shape of the steel sheet is easily disturbed and the possibility of causing problems in practical use increases. Therefore, the CT is preferably 100° C. or more. In view of material uniformity, the CT is preferably 150° C. or more.

When Nb and V are contained, the coiling temperature is preferably set at 550 to 650° C. In such a case, if the coiling temperature is higher than 650° C., since carbonitrides of Nb and V are coarsened, it becomes difficult to adjust the grain size thereof to 0.05 μm or less and the strength of the steel sheet is also decreased. If the CT is lower than 550° C., since precipitation of carbonitrides of Nb and V is suppressed, the predetermined amount of carbonitrides cannot be secured. Therefore, the CT is set at 550 to 650° C.

Furthermore, preferably, working (working after hot-rolling) is performed by at least one of skin pass rolling and leveling with an elongation of 1.5% to 10% after coiling is performed. Additionally, the elongation of skin pass rolling is equal to the reduction rate of skin pass rolling.

Skin pass rolling and leveling are usually performed to adjust roughness and to correct shape. In addition thereto, skin pass rolling and leveling are effective in increasing and stabilizing the BH and ΔTS. Such an effect is remarkably caused at an elongation of 1.5% or more. However, if the elongation exceeds 10%, ductility is decreased. Therefore, working after hot-rolling is preferably performed with an elongation of 1.5% to 10%. Additionally, although the working mode is different between skin pass rolling and leveling (the former is rolling and the latter is repeated bending and stretching), the effects of the elongation on the strain aging hardenability of the steel sheet in both workings are substantially the same. Acid pickling may be performed before or after the working after hot-rolling.

EXAMPLE 1

Each of the steels having the compositions shown in Table 1 was melted in a converter, and a slab was formed by continuous casting. The slab was hot-rolled under the conditions shown in Table 2 to produce a hot-rolled steel sheet. In finish-rolling, sheet bars were not joined to each other and tandem rolling was performed for the individual sheet bars. With respect to the resultant hot-rolled steel sheet, the dissolved N, the microstructure, the tensile characteristics, the strain aging hardenability, and improvements in fatigue resistance and impact resistance due to strain aging treatment were investigated.

The amount of dissolved N was measured by the method described above.

In order to observe the microstructure, with respect to the C cross section (the cross section perpendicular to the rolling direction) excluding the portions 10% from the surfaces in the thickness direction, the enlarged image of the structure appearing due to corrosion was analyzed.

The tensile tests for checking the tensile characteristics and the strain aging hardenability were performed according to JIS Z 2241 using JIS No. 5 test pieces.

The strain aging treatment was performed with a prestrain of 5% under the aging treatment conditions: 170° C.×20 minutes.

The fatigue resistance was evaluated by the fatigue limit obtained by a tensile fatigue test according to JIS Z 2273.

The impact resistance was evaluated by the absorbed energy found by integrating stress in the strain range of 0 to 30% with respect to the stress-strain curve measured at a strain rate of 2,000/s according to a high-speed tensile test method described in "Journal of the Society of Materials Science Japan. 47,10(1998)1058".

The results thereof are shown in Table 3. In the examples of the present invention, significantly higher BH and ΔTS were observed compared to the comparative examples, and the improvements in fatigue resistance and impact resistance due to the strain aging treatment were larger compared to the comparative examples.

Additionally, the characteristics of plated steel sheets obtained by hot-dip galvanizing the steel Nos. C and D were substantially the same as those of the steel sheets before plating. In order to perform plating treatment, the steel sheet was immersed in a galvanizing bath and after the immersed steel sheet was retrieved, the areal weight was Adjusted by gas-wiping. The plating treatment was performed under the conditions of sheet temperature: 475° C., plating bath: 0.13% Al—Zn, bath temperature: 475° C., immersion time: 3 seconds, and areal weight: 45 g/m$^2$.

EXAMPLE 2

The steel having the composition shown in Table 4 was cast into a slab in the same manner as Example 1, and the slab was hot-rolled under the conditions shown in Table 5. Thereby, hot-rolled steel sheets (with a thickness of 1.6 mm) in which the average cooling rates were greatly varied were obtained. In such a case, when finish-rolling was performed, consecutive sheet bars with a thickness of 25 mm were joined to each other by fusion-pressure welding at the initial stand, and tandem rolling was performed continuously. Between rough-rolling and finish-rolling, the temperature of the sheet bar was adjusted using a sheet bar edge heater and a sheet bar heater of induction heating type. The resultant hot-rolled steel sheets were investigated in the same manner as Example 1.

The results thereof are shown in Table 6. In all the steel sheets, it is,clear that the strain aging hardenability was stable at a high level. In Example 2, due to the continuous rolling and the temperature adjustment of the sheet bar, the thickness accuracy and the shape were improved compared to Example 1. Furthermore, since finish-rolling was continuously performed by joining consecutive sheet bars to each other, the rolling conditions and cooling conditions for one sheet bar were uniformly set in the entire length in the longitudinal direction. As a result, stable strain aging hardenability was confirmed over the entire length of the steel sheet.

EXAMPLE 3

Figure 2:
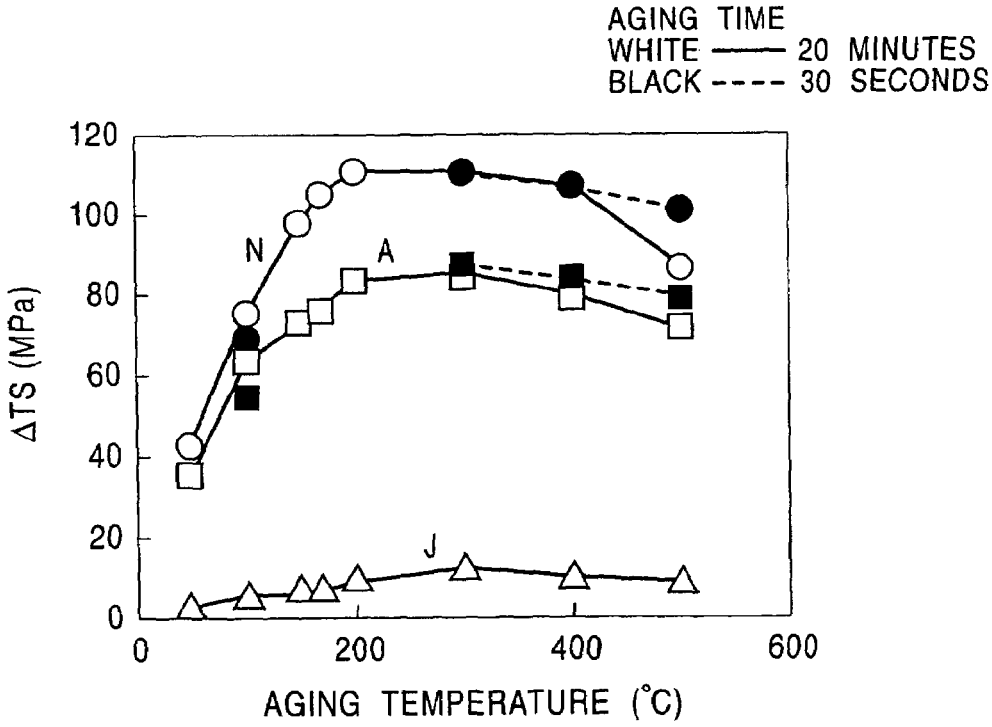
FIG. 2 is a graph which shows ΔTS (an increase in tensile strength) with respect to examples of disclosed steel sheets and comparative examples.

With respect to the steel sheet Nos. A, N, and J shown in Table 3, the BH (increase in deformation stress) and the ΔTS (increase in tensile strength) were investigated with varied aging treatment conditions. The results thereof are shown in FIGS. 1 and 2. In the examples of the present invention (A and N), significantly greater hardening was observed compared to the comparative example (J) in the low-temperature, short-time aging treatment. Thereby, it is obvious that the steel sheet of the present invention has superior strain aging hardenability. It is also clear that the examples A and N of the present invention exhibit superior strain aging hardenability under the strain aging treatment conditions in the wide ranges of 100 to 300° C.×30 seconds to 20 minutes.

EXAMPLE 4

Each of the steels having the compositions shown in Tables 7 and 8 was melted in a converter, and a slab was formed by continuous casting. The slab was hot-rolled under the conditions shown in Tables 9 and 10 to produce a hot-rolled steel sheet. With respect to the resultant hot-rolled steel sheet, the dissolved N, the microstructure, the tensile characteristics, strain aging hardenability, and improvements in fatigue resistance and impact resistance due to strain aging treatment were investigated.

The amount of dissolved N was measured by the method described above.

In order to observe the microstructure, with respect to the C cross section (the cross section perpendicular to the rolling direction) in the center in the thickness direction, the enlarged image of the structure appearing due to corrosion was analyzed.

The tensile tests for checking the tensile characteristics and the strain aging hardenability were performed according to JIS Z 2241 using JIS No. 5 test pieces.

The strain aging treatment was performed with a prestrain of 5% under the aging treatment conditions: 170° C.×20 minutes.

The fatigue resistance and the impact resistance were evaluated in the same manner as Example 1.

The results thereof are shown in Tables 11 and 12. In the examples, significantly higher BH and ΔTS were observed compared to the comparative examples, and the improvements in fatigue resistance and impact resistance due to the strain aging treatment were larger compared to the comparative examples.

Additionally, the characteristics of plated steel sheets obtained by hot-dip galvanizing the steel Nos. C and D were substantially the same as those of the steel sheets before plating. In order to perform plating treatment, the steel sheet was immersed in a galvanizing bath and after the immersed steel sheet was retrieved, the areal weight was adjusted by gas-wiping. The plating treatment was performed under the conditions of sheet temperature: 475° C., plating bath: 0.13% Al—Zn, bath temperature: 475° C., immersion time: 3 seconds, and areal weight 45 g/m$^2$.

With respect to the steel sheet No. A (inventive steels) and the steel sheet No. O (comparative steel) shown in Tables 11 and 12, BH and ΔTS were investigated with a prestrain of 5% under the aging treatment conditions shown in Table 13. Table 13 also shows the results thereof.

As is obvious from Table 13, the steel No. A exhibits high values of BH and ΔTS even under the relatively low-temperature, short-time aging treatment conditions of 100° C.×30 seconds.

EXAMPLE 5

Each of the steels having the compositions shown in Table 14 was melted in a converter, and a slab was formed by continuous casting. The slab was hot-rolled under the conditions shown in Table 15 to produce a hot-rolled steel sheet. In finish-rolling, sheet bars were not joined to each other and tandem rolling was performed for the individual sheet bars. With respect to the resultant hot-rolled steel sheet, the dissolved N, the microstructure, the tensile characteristics, the strain aging hardenability, and improvements in fatigue resistance and impact resistance due to strain aging treatment were investigated.

The amount of dissolved N, the amount of precipitated Nb*, and the amount of precipitated V were measured by the methods described above.

In order to observe the microstructure, with respect to the C cross section (the cross section perpendicular to the rolling direction) excluding the portions 10% from the surfaces in the thickness direction, the enlarged image of the structure appearing due to corrosion was analyzed. The average grain size of Nb and V carbonitrides was obtained using a transmission electron microscope and an energy-dispersive X-ray analyzer.

The tensile tests for checking the tensile characteristics and the strain aging hardenability were performed according to JIS Z 2241 using JIS No. 5 test pieces.

The strain aging treatment was performed with a prestrain of 5% under the aging treatment conditions: 170° C.×20 minutes.

The fatigue resistance and the impact resistance were evaluated by the methods described in Example 1. Furthermore, in order to evaluate the impact resistance and the fatigue resistance relative to the strength level of the steel sheet (strain aged steel), the ratio of absorbed energy En (MJ/) to the tensile strength TS (MPa) of the strain aged steel, En/TS (MJ/(MPa)) and the ratio of the fatigue limit σw (MPa) to the tensile strength TS (MPa) of the strain aged steel, σw/TS were obtained.

The results thereof are shown in Table 16. In the examples, the values of BH and ΔTS are large, and also high fatigue resistance and impact resistance are exhibited. The values of En/TS and σw/TS are also large, and superior fatigue resistance and impact resistance are exhibited compared to the comparative steels having the same strength level.

Additionally, the characteristics of a plated steel sheet obtained by hot-dip galvanizing the steel sheet No. C1 were substantially the same as those of the steel sheet before plating. In order to perform plating treatment, the steel sheet was immersed in a galvanizing bath and after the immersed steel sheet was retrieved, the areal weight was adjusted by gas-wiping. The plating treatment was performed under the conditions of sheet temperature: 475° C., plating bath: 0.13% Al—Zn, bath temperature: 475° C., immersion time: 3 seconds, and areal weight 45 g/m$^2$.

Industrial Applicability

With respect to the high tensile strength hot-rolled steel sheet, since dissolved N is appropriately used, the strength of the mother plate with a TS of 440 MPa or more is exhibited, and superior strain aging hardenability with a BH of 80 MPa or more and a ΔTS of 40 MPa or more is exhibited after strain aging treatment is performed. The same characteristics are exhibited after plating is performed, and moreover, it is possible to perform hot-rolling inexpensively without disturbing the shape. The thickness of the steel sheet used for automotive components can be decreased, for example, from approximately 2.0 mm to approximately 1.6 mm, thus greatly contributing to lightening of automobile bodies.

TABLE 2

| Steel Sheet No. | Steel No. | SRT ° C. | FDT ° C. | Thickness mm | Δt s | V ° C./s | CT ° C. | Others |
|---|---|---|---|---|---|---|---|---|
| A | 1 | 1,220 | 880 | 1.6 | 0.2 | 80 | 520 | — |
| B | 2 | 1,200 | 890 | 1.8 | 0.2 | 65 | 540 | — |
| C | 3 | 1,150 | 890 | 1.4 | 0.1 | 75 | 520 | — |
| D | 4 | 1,220 | 850 | 1.6 | 0.1 | 75 | 570 | — |
| E | 5 | 1,270 | 850 | 1.8 | 0.2 | 65 | 580 | — |
| F | 6 | 1,200 | 890 | 1.8 | 0.3 | 65 | 520 | — |
| G | 7 | 1,100 | 840 | 2.3 | 0.2 | 55 | 530 | — |
| H | 8 | 1,100 | 845 | 2.0 | 0.3 | 60 | 540 | — |
| I | 9 | 1,100 | 850 | 1.8 | 0.4 | 70 | 530 | HCR |
| J | 10 | 1,100 | 880 | 1.8 | 0.3 | 70 | 530 | — |
| K | 1 | 1,130 | 840 | 1.8 | 1.5 | 70 | 540 | — |
| L | 1 | 1,220 | 850 | 1.8 | 0.3 | 70 | 680 | — |
| M | 1 | 1,220 | 880 | 1.8 | 0.2 | 70 | 600 | — |
| N | 1 | 1,220 | 890 | 1.8 | 0.2 | 70 | 250 | LV |
| O | 1 | 1,230 | 880 | 1.4 | 0.2 | 73 | 420 | SK |
| P | 11 | 1,200 | 890 | 1.8 | 0.3 | 65 | 530 | — |
| Q | 12 | 1,200 | 890 | 1.8 | 0.3 | 65 | 530 | — |
| R | 13 | 1,200 | 890 | 1.8 | 0.3 | 65 | 530 | — |
| S | 14 | 1,200 | 890 | 1.8 | 0.3 | 65 | 530 | — |
| T | 15 | 1,200 | 890 | 1.8 | 0.3 | 65 | 530 | — |
| U | 16 | 1,200 | 890 | 1.8 | 0.3 | 65 | 530 | — |
| V | 17 | 1,200 | 890 | 1.8 | 0.3 | 65 | 530 | — |
| W | 18 | 1,200 | 890 | 1.8 | 0.3 | 65 | 530 | — |
| X | 19 | 1,200 | 890 | 1.8 | 0.3 | 65 | 530 | — |
| Y | 20 | 1,200 | 890 | 1.8 | 0.3 | 65 | 530 | — |
| Z | 21 | 1,200 | 890 | 1.8 | 0.3 | 65 | 530 | — |
| AA | 22 | 1,200 | 890 | 1.8 | 0.3 | 65 | 530 | — |
| AB | 23 | 1,150 | 890 | 1.4 | 0.5 | 40 | 646 | — |

SRT: Slab heating temperature
FDT: Finishing temperature in finish-rolling
CT: coiling temperature
Δt: Cooling delay time
V: Average cooling rate
HCR: Hot slab (900° C. or more) was inserted into furnace.
LV: Leveling after coiling (Elongation 1.5%)
SK: Skin pass rolling after coiling (Reduction rate 2.0%)

TABLE 1

| Steel No. | C % | Si % | Mn % | P % | S % | Al % | N % | N/Al | Others % |
|---|---|---|---|---|---|---|---|---|---|
| 1 | 0.07 | 0.25 | 1.80 | 0.015 | 0.003 | 0.012 | 0.0105 | 0.88 | — |
| 2 | 0.05 | 0.50 | 1.60 | 0.008 | 0.002 | 0.008 | 0.0150 | 1.88 | — |
| 3 | 0.08 | 0.15 | 2.00 | 0.010 | 0.002 | 0.011 | 0.0095 | 0.86 | — |
| 4 | 0.05 | 0.35 | 1.75 | 0.005 | 0.002 | 0.011 | 0.0120 | 1.09 | Mo: 0.15 |
| 5 | 0.05 | 0.45 | 1.65 | 0.045 | 0.001 | 0.007 | 0.0123 | 1.76 | — |
| 6 | 0.05 | 0.15 | 2.00 | 0.008 | 0.001 | 0.004 | 0.0140 | 3.50 | Ti: 0.015 |
| 7 | 0.03 | 0.15 | 2.00 | 0.008 | 0.001 | 0.011 | 0.0140 | 1.27 | Nb: 0.015, B: 0.0008 |
| 8 | 0.05 | 0.15 | 1.55 | 0.004 | 0.003 | 0.011 | 0.0121 | 1.10 | Ni: 0.05 |
| 9 | 0.05 | 0.15 | 1.61 | 0.008 | 0.002 | 0.005 | 0.0118 | 2.36 | Cu: 0.10, Ni: 0.05 |
| 10 | 0.07 | 0.25 | 1.80 | 0.015 | 0.003 | 0.004 | 0.0042 | 0.08 | — |
| 11 | 0.05 | 0.15 | 1.80 | 0.007 | 0.002 | 0.004 | 0.0140 | 3.50 | Cu: 0.15 |
| 12 | 0.05 | 0.15 | 1.80 | 0.007 | 0.002 | 0.004 | 0.0145 | 3.63 | V: 0.015 |
| 13 | 0.05 | 0.15 | 1.77 | 0.007 | 0.002 | 0.004 | 0.0142 | 3.55 | Cr: 0.15, Ti: 0.015 |
| 14 | 0.06 | 0.15 | 1.78 | 0.005 | 0.002 | 0.004 | 0.0141 | 3.53 | Nb: 0.015, V: 0.015 |
| 15 | 0.04 | 0.15 | 1.82 | 0.004 | 0.002 | 0.004 | 0.0139 | 3.48 | Ni: 0.05, Ti: 0.015 |
| 16 | 0.05 | 0.15 | 1.81 | 0.005 | 0.002 | 0.004 | 0.0141 | 3.53 | Cu: 0.10, B: 0.003 |
| 17 | 0.05 | 0.15 | 1.80 | 0.007 | 0.002 | 0.004 | 0.0140 | 3.50 | Ca: 0.0015 |
| 18 | 0.04 | 0.15 | 1.78 | 0.007 | 0.002 | 0.004 | 0.0141 | 3.53 | Cu: 0.10, Ca: 0.002 |
| 19 | 0.05 | 0.15 | 1.77 | 0.005 | 0.002 | 0.004 | 0.0140 | 3.53 | Nb: 0.020, REM: 0.002 |
| 20 | 0.05 | 0.15 | 1.81 | 0.006 | 0.002 | 0.004 | 0.0140 | 3.50 | B: 0.0003 |
| 21 | 0.05 | 0.15 | 1.80 | 0.007 | 0.002 | 0.004 | 0.0140 | 3.50 | B: 0.0002, REM: 0.002 |
| 22 | 0.04 | 0.15 | 1.79 | 0.007 | 0.002 | 0.004 | 0.0141 | 3.53 | Cr: 0.10, Nb: 0.02<br>B: 0.0003, Ca: 0.0015 |
| 23 | 0.08 | 0.15 | 2.00 | 0.010 | 0.002 | 0.016 | 0.0050 | 0.31 | — |

(The balance being Fe and incidental impurities)

TABLE 3

| Steel Sheet No. | Dissolved N in steel sheet % | Steel sheet structure Phase composition | vα % | d μm | Steel sheet tensile characteristics YS MPa | TS MPa | El % | Strain aging harden-ability BH MPa | ΔTS MPa | Fatigue resistance MPa | Impact resistance | Remarks (PI: Example of present invention CE: Comparative example) |
|---|---|---|---|---|---|---|---|---|---|---|---|---|
| A | 0.0071 | F,P,B | 85 | 8.2 | 351 | 474 | 38 | 113 | 55 | 95 | 1.18 | PI |
| B | 0.0121 | F,P,B | 90 | 8.4 | 368 | 469 | 36 | 110 | 52 | 90 | 1.15 | PI |
| C | 0.0060 | F,B | 85 | 7.9 | 355 | 512 | 35 | 115 | 61 | 97 | 1.19 | PI |
| D | 0.0082 | F,B | 87 | 7.8 | 365 | 532 | 34 | 115 | 63 | 98 | 1.18 | PI |
| E | 0.0112 | F,P,B | 92 | 8.1 | 338 | 485 | 37 | 108 | 55 | 94 | 1.16 | PI |
| F | 0.0075 | F,B | 85 | 7.4 | 353 | 508 | 36 | 92 | 62 | 98 | 1.19 | PI |
| G | 0.0088 | F,B | 83 | 5.9 | 411 | 610 | 31 | 112 | 74 | 101 | 1.19 | PI |
| H | 0.0084 | F,P | 93 | 7.8 | 326 | 465 | 37 | 108 | 52 | 88 | 1.15 | PI |
| I | 0.0102 | F,B | 88 | 8.3 | 331 | 475 | 38 | 105 | 55 | 89 | 1.13 | PI |
| J | 0.0002 | F,P,B | 85 | 8.4 | 334 | 454 | 37 | 22 | 5 | 0 | 1.00 | CE |
| K | 0.0008 | F,P,B | 90 | 10.8 | 332 | 434 | 38 | 32 | 15 | 20 | 1.01 | CE |
| L | 0.0005 | F,P | 95 | 11.0 | 295 | 411 | 38 | 10 | 12 | 18 | 0.99 | CE |
| M | 0.0065 | R,P,B | 86 | 8.3 | 348 | 468 | 38 | 110 | 50 | 93 | 1.13 | PI |
| N | 0.0100 | F,M | 83 | 7.9 | 363 | 605 | 34 | 155 | 105 | 125 | 1.25 | PI |
| O | 0.0105 | F,M,B | 86 | 7.6 | 355 | 481 | 37 | 118 | 63 | 112 | 1.20 | PI |
| P | 0.0095 | F,B | 85 | 7.7 | 361 | 485 | 38 | 120 | 69 | 105 | 1.21 | PI |
| Q | 0.0093 | F,B | 87 | 7.4 | 371 | 480 | 36 | 118 | 59 | 98 | 1.18 | PI |
| R | 0.0082 | F,B,M | 82 | 6.5 | 365 | 505 | 38 | 119 | 71 | 102 | 1.18 | PI |
| S | 0.0075 | F,B | 82 | 6.3 | 381 | 485 | 37 | 119 | 69 | 103 | 1.20 | PI |
| T | 0.0085 | F,B | 85 | 6.5 | 359 | 479 | 38 | 115 | 56 | 99 | 1.19 | PI |
| U | 0.0072 | F,B | 84 | 7.2 | 358 | 480 | 38 | 115 | 57 | 98 | 1.18 | PI |
| V | 0.0098 | F,B | 85 | 8.1 | 355 | 475 | 39 | 102 | 65 | 101 | 1.19 | PI |
| W | 0.0101 | F,B | 83 | 8.0 | 365 | 480 | 38 | 113 | 69 | 104 | 1.18 | PI |
| X | 0.0095 | F,B | 81 | 5.9 | 480 | 510 | 36 | 119 | 75 | 102 | 1.19 | PI |
| Y | 0.0120 | F,B | 85 | 7.1 | 355 | 475 | 39 | 115 | 59 | 99 | 1.19 | PI |
| Z | 0.0115 | F,B | 85 | 7.2 | 360 | 479 | 38 | 115 | 61 | 102 | 1.18 | PI |
| AA | 0.0115 | F,B | 82 | 5.8 | 369 | 525 | 37 | 118 | 65 | 109 | 1.19 | PI |
| AB | 0.0011 | F,P,B | 85 | 9.5 | 368 | 471 | 36 | 99 | 53 | 88 | 1.18 | PI |

F: Ferrite
P: Pearlite
B: Bainite
M: Martensite
Vα: Areal rate of ferrite phase
d: Average grain size of ferrite phase
Fatigue resistance = (Fatigue limit of strain aged steel) − (Fatigue limit of steel as hot-rolled)
Impact resistance = (Absorbed energy of strain aged steel) / (Absorbed energy of steel as hot-rolled)

TABLE 4

| Steel No. | C % | Si % | Mn % | P % | S % | Al % | N % | N/Al | Oth-ers % |
|---|---|---|---|---|---|---|---|---|---|
| 24 | 0.08 | 0.35 | 1.55 | 0.009 | 0.002 | 0.012 | 00135 | 1.11 | — |

(The balance being Fe and incidental impurities)

TABLE 5

| Steel Sheet No. | Steel No. | SRT ° C. | FDT ° C. | Thickness mm | Δt s | V ° C./s | CT ° C. | Others | Remarks |
|---|---|---|---|---|---|---|---|---|---|
| AC | 11 | 1,280 | 920 | 1.6 | 0.2 | 95 | 480 | Continuous rolling | PI |
| AD | 11 | 1,220 | 890 | 1.6 | 0.2 | 65 | 520 | Continuous rolling | PI |
| AE | 11 | 1,180 | 925 | 1.6 | 0.1 | 100 | 520 | Continuous rolling | PI |

TABLE 6

| Steel Sheet No. | Dissolved N in steel sheet % | Steel sheet structure Phase composition | vα % | d μm | Steel sheet tensile characteristics YS MPa | TS MPa | El % | Strain aging harden-ability BH MPa | ΔTS MPa | Fatigue resistance MPa | Impact resistance | Remarks (PI: Example of present invention CE: Comparative example) |
|---|---|---|---|---|---|---|---|---|---|---|---|---|
| AC | 0.0095 | F,P,B | 88 | 8.1 | 351 | 474 | 38 | 115 | 58 | 95 | 1.19 | PI |
| AD | 0.0092 | F,P,B | 89 | 8.3 | 368 | 469 | 37 | 110 | 52 | 90 | 1.15 | PI |
| AE | 0.0088 | F,P,B | 85 | 7.6 | 364 | 495 | 37 | 115 | 65 | 100 | 1.18 | PI |

TABLE 7

| Steel No. | C % | Si % | Mn % | P % | S % | Al % | N % | N/Al | Others % |
|---|---|---|---|---|---|---|---|---|---|
| 1 | 0.07 | 0.25 | 1.80 | 0.015 | 0.003 | 0.012 | 0.0105 | 0.88 | — |
| 2 | 0.05 | 0.50 | 1.60 | 0.008 | 0.002 | 0.008 | 0.0150 | 1.88 | — |
| 3 | 0.08 | 0.15 | 2.00 | 0.010 | 0.002 | 0.011 | 0.0095 | 0.86 | — |
| 4 | 0.05 | 0.35 | 1.75 | 0.005 | 0.002 | 0.011 | 0.0120 | 1.09 | Mo: 0.15 |
| 5 | 0.05 | 0.45 | 1.65 | 0.045 | 0.001 | 0.007 | 0.0123 | 1.76 | — |
| 6 | 0.05 | 0.15 | 2.00 | 0.008 | 0.001 | 0.004 | 0.0140 | 3.50 | Ti: 0.015 |
| 7 | 0.03 | 0.15 | 2.00 | 0.008 | 0.001 | 0.011 | 0.0140 | 1.27 | Nb: 0.015, B: 0.0008 |
| 8 | 0.05 | 0.15 | 1.55 | 0.004 | 0.003 | 0.011 | 0.0121 | 1.10 | Ni: 0.05 |
| 9 | 0.05 | 0.15 | 1.61 | 0.008 | 0.002 | 0.005 | 0.0118 | 2.36 | Cu: 0.10, Ni: 0.05 |
| 10 | 0.07 | 0.25 | 1.80 | 0.015 | 0.003 | 0.055 | 0.0042 | 0.08 | — |
| 11 | 0.08 | 0.35 | 1.55 | 0.009 | 0.002 | 0.012 | 0.0135 | 1.12 | Mo: 0.50 |
| 12 | 0.05 | 0.15 | 1.80 | 0.007 | 0.002 | 0.004 | 0.0140 | 3.50 | Cu: 0.15 |

(The balance being Fe and incidental impurities)

TABLE 8

| Steel No. | C % | Si % | Mn % | P % | S % | Al % | N % | N/Al | Others % |
|---|---|---|---|---|---|---|---|---|---|
| 13 | 0.05 | 0.15 | 1.80 | 0.007 | 0.002 | 0.004 | 0.0145 | 3.63 | V: 0.015 |
| 14 | 0.05 | 0.15 | 1.77 | 0.007 | 0.002 | 0.004 | 0.0142 | 3.55 | Cr: 0.15, Ti: 0.015 |
| 15 | 0.06 | 0.15 | 1.78 | 0.005 | 0.002 | 0.004 | 0.0141 | 3.53 | Nb: 0.015, V: 0.015 |
| 16 | 0.04 | 0.15 | 1.82 | 0.004 | 0.002 | 0.004 | 0.0139 | 3.48 | Ni: 0.05, Ti: 0.015 |
| 17 | 0.05 | 0.15 | 1.81 | 0.005 | 0.002 | 0.004 | 0.0141 | 3.53 | Cu: 0.10, B: 0.0030 |
| 18 | 0.05 | 0.15 | 1.80 | 0.007 | 0.002 | 0.004 | 0.0140 | 3.50 | Ca: 0.0015 |
| 19 | 0.04 | 0.15 | 1.78 | 0.007 | 0.002 | 0.004 | 0.0141 | 3.53 | Cu: 0.10, Ca: 0.0020 |
| 20 | 0.05 | 0.15 | 1.77 | 0.005 | 0.002 | 0.004 | 0.0140 | 3.53 | Nb: 0.020, REM: 0.0020 |
| 21 | 0.05 | 0.15 | 1.81 | 0.006 | 0.002 | 0.004 | 0.0140 | 3.50 | B: 0.0003 |
| 22 | 0.05 | 0.15 | 1.80 | 0.007 | 0.002 | 0.004 | 0.0140 | 3.50 | B: 0.0002, REM: 0.0020 |
| 23 | 0.04 | 0.15 | 1.79 | 0.007 | 0.002 | 0.004 | 0.0141 | 3.53 | Cr: 0.10, Nb: 0.02 B: 0.003, Ca: 0.0015 |
| 24 | 0.08 | 0.15 | 2.00 | 0.010 | 0.002 | 0.016 | 0.0050 | 0.31 | – |
| 25 | 0.06 | 0.15 | 2.65 | 0.015 | 0.002 | 0.012 | 0.0142 | 1.18 | Nb: 0.008, Ti: 0.005 |
| 26 | 0.08 | 0.15 | 2.95 | 0.015 | 0.002 | 0.005 | 0.0180 | 3.60 | — |
| 27 | 0.08 | 0.45 | 2.90 | 0.011 | 0.002 | 0.011 | 0.0175 | 1.59 | Nb: 0.038 |

(The balance being Fe and incidental impurities)

TABLE 9

| Steel Sheet No. | Steel No. | SRT ° C. | FDT ° C. | Thickness mm | Δt s | V ° C./s | CT ° C. | Others |
|---|---|---|---|---|---|---|---|---|
| A | 1 | 1,180 | 880 | 2.3 | 0.3 | 55 | 280 | — |
| B | 2 | 1,180 | 880 | 2.3 | 0.3 | 55 | 400 | — |
| C | 3 | 1,170 | 880 | 2.3 | 0.3 | 55 | 380 | — |
| D | 4 | 1,200 | 890 | 1.6 | 0.3 | 60 | 380 | — |
| E | 5 | 1,220 | 890 | 1.6 | 0.3 | 60 | 400 | JCR |
| F | 6 | 1,200 | 890 | 1.6 | 0.3 | 60 | 325 | — |
| G | 7 | 1,220 | 870 | 1.6 | 0.3 | 60 | 280 | — |

TABLE 9-continued

| Steel Sheet No. | Steel No. | SRT ° C. | FDT ° C. | Thickness mm | Δt s | V ° C./s | CT ° C. | Others |
|---|---|---|---|---|---|---|---|---|
| H | 8 | 1,270 | 870 | 1.6 | 0.3 | 60 | 250 | — |
| I | 9 | 1,250 | 850 | 1.8 | 0.2 | 60 | 320 | HCR |
| J | 10 | 1,250 | 850 | 1.8 | 0.2 | 60 | 350 | — |
| K | 1 | 1,270 | 850 | 1.8 | 0.2 | 60 | 350 | — |
| L | 1 | 1,250 | 850 | 1.4 | 0.2 | 70 | 290 | LV |
| M | 1 | 1,250 | 850 | 1.4 | 0.2 | 70 | 320 | — |
| N | 1 | 1,250 | 850 | 1.4 | 0.2 | 70 | 560 | — |

TABLE 9-continued

| Steel Sheet No. | Steel No. | SRT ° C. | FDT ° C. | Thickness mm | Δt s | V ° C./s | CT ° C. | Others |
|---|---|---|---|---|---|---|---|---|
| O | 1 | 950 | 720 | 1.4 | 0.2 | 70 | 350 | — |
| P | 11 | 1,180 | 880 | 2.0 | 0.2 | 50 | 350 | SK |

SRT: Slab heating temperature
FDT: Finishing temperature in finish-rolling
CT: coiling temperature
Δt: Cooling delay time
V: Average cooling rate
HCR: Hot slab (90° C. or more) was inserted into furnace.
JCR: Sheet bar joining and continuous rolling
LV: Leveling after coiling (Elongation 2%)
SK: Skin pass rolling after coiling (Reduction rate 1.0%)

TABLE 10

| Steel Sheet No. | Steel No. | SRT ° C. | FDT ° C. | Thickness mm | Δt s | V ° C./s | CT ° C. | Others |
|---|---|---|---|---|---|---|---|---|
| Q | 11 | 1,180 | 880 | 2.0 | 2.0 | 55 | 360 | — |
| R | 11 | 1,180 | 880 | 2.0 | 0.2 | 10 | 350 | — |
| S | 12 | 1,200 | 885 | 1.6 | 0.3 | 55 | 250 | — |
| T | 13 | 1,220 | 890 | 1.6 | 0.3 | 60 | 350 | — |
| U | 14 | 1,220 | 900 | 1.6 | 0.2 | 55 | 300 | — |
| V | 15 | 1,220 | 885 | 1.6 | 0.3 | 55 | 300 | — |
| W | 16 | 1,200 | 895 | 1.6 | 0.3 | 55 | 300 | — |

TABLE 10-continued

| Steel Sheet No. | Steel No. | SRT ° C. | FDT ° C. | Thickness mm | Δt s | V ° C./s | CT ° C. | Others |
|---|---|---|---|---|---|---|---|---|
| X | 17 | 1,200 | 890 | 1.6 | 0.3 | 55 | 280 | — |
| Y | 18 | 1,220 | 900 | 1.6 | 0.3 | 60 | 250 | — |
| Z | 19 | 1,200 | 905 | 1.6 | 0.3 | 55 | 280 | — |
| AA | 20 | 1,220 | 910 | 1.6 | 0.3 | 50 | 250 | — |
| AB | 21 | 1,180 | 910 | 1.6 | 0.2 | 55 | 250 | — |
| AC | 22 | 1,180 | 910 | 1.6 | 0.3 | 60 | 280 | — |
| AD | 23 | 1,200 | 900 | 1.6 | 0.2 | 65 | 250 | — |
| AE | 24 | 1,210 | 890 | 1.6 | 0.4 | 40 | 320 | — |
| AF | 25 | 1,170 | 870 | 1.6 | 0.4 | 45 | 380 | — |
| AG | 26 | 1,200 | 890 | 1.6 | 0.4 | 85 | 400 | — |
| AH | 27 | 1,250 | 910 | 1.6 | 0.3 | 65 | 420 | — |

SRT: Slab heating temperature
FDT: Finishing temperature in finish-rolling
CT: coiling temperature
Δt: Cooling delay time
V: Average cooling rate
HCR: Hot slab (90° C. or more) was inserted into furnace.
JCR: Sheet bar joining and continuous rolling
LV: Leveling after coiling (Elongation 2%)
SK: Skin pass rolling after coiling (Reduction rate 1.0%)

TABLE 11

| Steel Sheet No. | Dissolved N in steel sheet % | Steel sheet structure: Phase composition | Vα % | d μm | VM % | Steel sheet tensile characteristics: YS MPa | TS MPa | YR | El % | Strain aging hardenability: BH MPa | ΔTS MPa | Fatigue resistance MPa | Impact resistance | Remarks (PI: Example of present invention CE: Comparative example) |
|---|---|---|---|---|---|---|---|---|---|---|---|---|---|---|
| A | 0.0080 | F,M,B | 81 | 6.9 | 17 | 403 | 620 | 0.65 | 32 | 151 | 85 | 125 | 1.29 | PI |
| B | 0.0120 | F,M,B | 87 | 6.9 | 12 | 385 | 598 | 0.64 | 33 | 150 | 95 | 119 | 1.28 | PI |
| C | 0.0072 | F,M | 79 | 5.7 | 21 | 415 | 645 | 0.64 | 30 | 165 | 90 | 118 | 1.28 | PI |
| D | 0.0097 | F,M | 82 | 6.8 | 18 | 402 | 625 | 0.64 | 31 | 150 | 101 | 121 | 1.31 | PI |
| E | 0.0105 | F,M,B | 86 | 6.8 | 12 | 395 | 605 | 0.65 | 31 | 150 | 92 | 115 | 1.28 | PI |
| F | 0.0110 | F,M | 79 | 6.1 | 21 | 420 | 650 | 0.65 | 29 | 161 | 90 | 122 | 1.27 | PI |
| G | 0.0085 | F,M | 89 | 6.7 | 11 | 367 | 565 | 0.65 | 34 | 150 | 102 | 119 | 1.29 | PI |
| H | 0.0095 | F,M,B | 86 | 6.8 | 12 | 370 | 570 | 0.65 | 33 | 151 | 88 | 125 | 1.28 | PI |
| I | 0.0085 | F,M,B | 85 | 6.6 | 14 | 391 | 605 | 0.65 | 32 | 155 | 105 | 115 | 1.31 | PI |
| J | 0.0008 | F,M,B | 81 | 6.9 | 13 | 385 | 595 | 0.65 | 28 | 75 | 42 | 45 | 1.10 | CE |
| K | 0.0085 | F,M,B | 82 | 6.9 | 16 | 401 | 620 | 0.65 | 31 | 159 | 87 | 115 | 1.27 | PI |
| L | 0.0087 | F,M | 83 | 6.6 | 17 | 420 | 630 | 0.67 | 31 | 160 | 85 | 120 | 1.28 | PI |
| M | 0.0087 | F,M | 83 | 6.6 | 17 | 405 | 620 | 0.65 | 32 | 150 | 92 | 115 | 1.29 | PI |
| N | 0.0085 | F,P,B | 90 | 8.0 | 0 | 415 | 530 | 0.78 | 29 | 72 | 15 | 51 | 1.09 | CE |
| O | 0.0045 | F,B,M | 97 | 10.9 | 3 | 395 | 505 | 0.78 | 34 | 40 | 10 | 57 | 1.08 | CE |
| P | 0.0082 | F,M | 85 | 6.8 | 15 | 342 | 598 | 0.57 | 32 | 145 | 88 | 115 | 1.27 | PI |

F: Ferrite, P: Pearlite, B: Bainite, M: Martensite
Vα: Areal rate of ferrite phase, d: Average grain size of ferrite phase, VM: Areal rate of martensite phase
Fatigue resistance = (Fatigue limit of strain aged steel) − (Fatigue limit of steel as hot-rolled)
Impact resistance = (Absorbed energy of strain aged steel) / (Absorbed energy of steel as hot-rolled)

TABLE 12

| Steel Sheet No. | Dissolved N in steel sheet % | Steel sheet structure: Phase composition | Vα % | d μm | VM % | Steel sheet tensile characteristics: YS MPa | TS MPa | YR | El % | Strain aging hardenability: BH MPa | ΔTS MPa | Fatigue resistance MPa | Impact resistance | Remarks (PI: Example of present invention CE: Comparative example) |
|---|---|---|---|---|---|---|---|---|---|---|---|---|---|---|
| Q | 0.0042 | F,P,B,M | 95 | 10.5 | 3 | 392 | 520 | 0.78 | 33 | 70 | 15 | 53 | 1.08 | CE |
| R | 0.0032 | F,P,B,M | 97 | 10.5 | 2 | 406 | 520 | 0.78 | 33 | 65 | 18 | 55 | 1.09 | CE |
| S | 0.0115 | F,M | 82 | 6.7 | 18 | 404 | 628 | 0.64 | 31 | 152 | 102 | 122 | 1.30 | PI |
| T | 0.0125 | F,M,B | 83 | 6.8 | 16 | 400 | 630 | 0.63 | 31 | 138 | 105 | 118 | 1.29 | PI |
| U | 0.0110 | F,M | 82 | 6.6 | 18 | 415 | 640 | 0.67 | 31 | 152 | 105 | 120 | 1.31 | PI |
| V | 0.0120 | F,M | 84 | 5.9 | 16 | 410 | 645 | 0.63 | 30 | 155 | 105 | 125 | 1.30 | PI |
| W | 0.0105 | F,M | 84 | 6.4 | 16 | 395 | 625 | 0.63 | 31 | 145 | 102 | 120 | 1.28 | PI |
| X | 0.0105 | F,M | 83 | 6.4 | 17 | 390 | 615 | 0.63 | 32 | 140 | 95 | 105 | 1.25 | PI |
| Y | 0.0120 | F,M | 84 | 6.2 | 16 | 370 | 615 | 0.60 | 31 | 150 | 98 | 110 | 1.28 | PI |
| Z | 0.0115 | F,M | 85 | 6.1 | 16 | 365 | 619 | 0.58 | 31 | 155 | 102 | 115 | 1.25 | PI |
| AA | 0.0120 | F,M | 85 | 5.2 | 15 | 445 | 649 | 0.68 | 31 | 168 | 95 | 125 | 1.32 | PI |
| AB | 0.0120 | F,M | 82 | 6.7 | 18 | 385 | 620 | 0.62 | 32 | 151 | 105 | 115 | 1.28 | PI |
| AC | 0.0110 | F,M | 83 | 6.8 | 17 | 380 | 620 | 0.61 | 32 | 145 | 105 | 110 | 1.25 | PI |
| AD | 0.0105 | F,M | 80 | 6.4 | 20 | 405 | 669 | 0.60 | 30 | 140 | 108 | 105 | 1.24 | PI |
| AE | 0.0010 | P,M,B | 87 | 6.9 | 10 | 365 | 595 | 0.61 | 33 | 105 | 72 | 95 | 1.18 | PI |
| AF | 0.0086 | F,M | 49 | 7.0 | 51 | 540 | 795 | 0.68 | 19 | 95 | 71 | 95 | 1.15 | PI |
| AG | 0.0135 | F,M,B | 45 | 5.1 | 42 | 600 | 997 | 0.60 | 14 | 153 | 102 | 98 | 1.05 | PI |
| AH | 0.0131 | F,B,M | 45 | 5.3 | 12 | 650 | 1,080 | 0.60 | 13 | 145 | 98 | 94 | 1.06 | PI |

F: Ferrite, P: Pearlite, B: Bainite, M: Martensite
Vα: Areal rate of ferrite phase, d: Average grain size of ferrite phase, VM: Areal rate of martensite phase
Fatigue resistance = (Fatigue limit of strain aged steel) − (Fatigue limit of steel as hot-rolled)
Impact resistance = (Absorbed energy of strain aged steel) / (Absorbed energy of steel as hot-rolled)

TABLE 13

| Aging treatment conditions: Heat-treating temperature | Heat-treating time | A (Steel of present invention): BH (MPa) | ΔTS (MPa) | O (Comparative steel): BH (MPa) | ΔTS (MPa) |
|---|---|---|---|---|---|
| 100° C. | 30 sec | 120 | 60 | 20 | 3 |
| 100° C. | 10 min | 130 | 70 | 24 | 3 |
| 100° C. | 20 min | 135 | 75 | 25 | 4 |
| 300° C. | 30 sec | 140 | 65 | 30 | 5 |

TABLE 13-continued

| Aging treatment conditions: Heat-treating temperature | Heat-treating time | A (Steel of present invention): BH (MPa) | ΔTS (MPa) | O (Comparative steel): BH (MPa) | ΔTS (MPa) |
|---|---|---|---|---|---|
| 300° C. | 10 min | 155 | 70 | 35 | 5 |
| 300° C. | 20 min | 160 | 70 | 40 | 10 |
| 170° C. | 20 min | 151 | 85 | 40 | 10 |

TABLE 14

| Steel No. | C % | Si % | Mn % | P % | S % | Al % | N % | Nb % | V % | N/Al – |
|---|---|---|---|---|---|---|---|---|---|---|
| A | 0.06 | 0.02 | 1.2 | 0.012 | 0.0030 | 0.015 | 0.015 | 0.2 | — | 1.0 |
| B | 0.08 | 0.02 | 1.0 | 0.010 | 0.0050 | 0.015 | 0.015 | 0.040 | — | 1.0 |
| C | 0.05 | 0.02 | 1.4 | 0.010 | 0.0040 | 0.012 | 0.015 | 0.070 | — | 1.25 |
| D | 0.08 | 0.4 | 1.7 | 0.015 | 0.0040 | 0.015 | 0.015 | 0.050 | — | 1.0 |
| E | 0.05 | 0.2 | 1.2 | 0.010 | 0.0050 | 0.011 | 0.015 | 0.010 | — | 1.36 |
| F | 0.04 | 0.1 | 1.3 | 0.012 | 0.0030 | 0.015 | 0.017 | — | 0.15 | 1.13 |
| G | 0.08 | 0.02 | 1.4 | 0.015 | 0.0040 | 0.015 | 0.015 | — | 0.05 | 1.0 |
| H | 0.06 | 0.7 | 0.9 | 0.010 | 0.0030 | 0.017 | 0.020 | — | 0.08 | 1.18 |
| I | 0.08 | 0.8 | 1.8 | 0.007 | 0.0020 | 0.004 | 0.014 | — | 0.010 | 3.5 |
| J | 0.05 | 0.1 | 1.2 | 0.010 | 0.0040 | 0.010 | 0.018 | 0.03 | 0.03 | 1.8 |
| K | 0.03 | 0.2 | 1.8 | 0.010 | 0.0030 | 0.012 | 0.0010 | 0.04 | — | 0.08 |
| L | 0.06 | 0.01 | 1.5 | 0.015 | 0.0050 | 0.010 | 0.004 | — | 0.05 | 0.4 |

(The balance being Fe and incidental impurities)

TABLE 15

| Steel No. | Steel sheet No. | SRT ° C. | FDT ° C. | Thickness mm | Δt s | V ° C./s | CT ° C. |
|---|---|---|---|---|---|---|---|
| A | A1 | 1,220 | 820 | 1.6 | 0.2 | 50 | 600 |
| B | B1 | 1,250 | 850 | 1.8 | 0.1 | 50 | 550 |
| | B2 | 1,250 | 850 | 1.8 | 0.1 | 50 | 700 |
| | B3 | 1,250 | 850 | 1.8 | 0.1 | 50 | 450 |
| | B4 | 1,050 | 850 | 1.8 | 0.1 | 50 | 600 |
| C | C1 | 1,250 | 880 | 1.4 | 0.1 | 80 | 550 |
| D | D1 | 1,220 | 880 | 2.9 | 0.3 | 50 | 600 |
| E | E1 | 1,220 | 850 | 1.8 | 0.2 | 50 | 600 |
| F | F1 | 1,250 | 850 | 1.6 | 0.2 | 60 | 640 |
| G | G1 | 1,220 | 850 | 1.4 | 0.1 | 100 | 550 |
| | G2 | 1,220 | 850 | 1.4 | 0.1 | 100 | 720 |
| | G3 | 1,220 | 850 | 1.4 | 0.1 | 100 | 450 |
| | G4 | 1,220 | 850 | 1.4 | 1.0 | 100 | 600 |

TABLE 15-continued

| Steel No. | Steel sheet No. | SRT ° C. | FDT ° C. | Thickness mm | Δt s | V ° C./s | CT ° C. |
|---|---|---|---|---|---|---|---|
| H | H1 | 1,250 | 880 | 2.3 | 0.2 | 50 | 600 |
| I | I1 | 1,250 | 850 | 1.6 | 0.2 | 50 | 540 |
| J | J1 | 1,230 | 880 | 2.0 | 0.2 | 50 | 560 |
| | J2 | 1,250 | 880 | 2.0 | 0.2 | 10 | 640 |
| K | K1 | 1,250 | 880 | 1.8 | 0.1 | 60 | 580 |
| L | L1 | 1,250 | 850 | 1.6 | 0.3 | 50 | 600 |

SRT: Slab heating temperature

FDT: Finishing temperature in finish-rolling

CT: coiling temperature

Δt: Cooling delay time

V: Average cooling rate

TABLE 16

| Steel Sheet No. | Dissolved N in steel sheet % | Steel sheet Nb* + V* % | Steel sheet structure: Phase composition | Vα % | d μm | dp μm | Steel sheet Tensile characteristics: YS MPa | TS MPa | El % | Strain aging hardenability: BH MPa | ΔTS MPa | Fatigue resistance MPa | Impact resistance | En/TS | $\sigma_w$/TS | Remarks (PI: Example of present invention CE: Comparative example) |
|---|---|---|---|---|---|---|---|---|---|---|---|---|---|---|---|---|
| A1 | 0.0020 | 0.080 | F + B | 92 | 10.2 | 0.5 | 405 | 581 | 26 | 82 | 35 | 35 | 1.02 | 0.29 | 0.82 | CE |
| B1 | 0.0120 | 0.032 | F + B | 90 | 6.8 | 0.03 | 515 | 624 | 28 | 88 | 46 | 103 | 1.19 | 0.33 | 1.05 | PI |
| B2 | 0.0009 | 0.038 | F + B | 97 | 12.4 | 0.19 | 402 | 583 | 29 | 32 | 8 | 18 | 1.04 | 0.28 | 0.80 | CE |
| B3 | 0.0140 | 0.008 | F + B | 78 | 6.2 | 0.02 | 467 | 649 | 24 | 91 | 42 | 106 | 1.22 | 0.30 | 0.96 | CE |
| B4 | 0.0015 | 0.031 | F + B | 95 | 9.8 | 0.8 | 410 | 592 | 25 | 81 | 40 | 88 | 1.13 | 0.29 | 0.98 | CE |
| C1 | 0.0142 | 0.057 | F + B | 92 | 6.8 | 0.03 | 515 | 617 | 27 | 84 | 44 | 105 | 1.18 | 0.34 | 1.03 | PI |
| D1 | 0.0090 | 0.041 | F + P + B | 82 | 5.9 | 0.02 | 652 | 804 | 19 | 87 | 42 | 95 | 1.15 | 0.33 | 1.07 | PI |
| E1 | 0.0092 | 0.008 | F + B | 94 | 6.5 | 0.03 | 390 | 566 | 30 | 88 | 42 | 99 | 1.16 | 0.31 | 0.90 | CE |
| F1 | 0.0030 | 0.071 | F + B | 92 | 11.8 | 0.3 | 451 | 610 | 24 | 81 | 20 | 38 | 1.03 | 0.30 | 0.84 | CE |
| G1 | 0.0125 | 0.041 | F + B | 95 | 6.9 | 0.02 | 521 | 622 | 27 | 84 | 44 | 102 | 1.18 | 0.34 | 1.07 | PI |
| G2 | 0.0008 | 0.045 | F + B | 98 | 11.6 | 0.28 | 392 | 571 | 29 | 25 | 4 | 21 | 1.02 | 0.29 | 0.79 | CE |
| G3 | 0.0139 | 0.009 | F + B | 82 | 5.5 | 0.02 | 450 | 655 | 22 | 87 | 42 | 104 | 1.19 | 0.30 | 0.94 | CE |
| G4 | 0.0009 | 0.030 | F + B | 94 | 10.3 | 0.04 | 396 | 577 | 29 | 31 | 5 | 19 | 1.01 | 0.29 | 0.81 | CE |
| H1 | 0.0182 | 0.060 | F + B | 90 | 5.9 | 0.02 | 655 | 811 | 18 | 88 | 40 | 98 | 1.15 | 0.33 | 1.04 | PI |
| I1 | 0.0125 | 0.009 | F + P + B | 85 | 6.2 | 0.02 | 559 | 804 | 17 | 81 | 42 | 100 | 1.18 | 0.31 | 0.96 | CE |
| J1 | 0.0155 | 0.048 | F + B | 92 | 6.8 | 0.02 | 529 | 621 | 28 | 84 | 45 | 102 | 1.21 | 0.34 | 1.06 | PI |
| J2 | 0.0008 | 0.021 | F + B | 97 | 10.9 | 0.07 | 381 | 560 | 29 | 27 | 7 | 24 | 1.02 | 0.30 | 0.83 | CE |
| K1 | 0.0002 | 0.017 | F + B | 90 | 6.2 | 0.03 | 467 | 599 | 28 | 11 | 2 | 19 | 1.00 | 0.29 | 0.80 | CE |
| L1 | 0.0009 | 0.026 | F + B | 93 | 6.9 | 0.04 | 472 | 602 | 29 | 20 | 5 | 21 | 1.04 | 0.29 | 0.81 | CE |

F: Ferrite, P: Pearlite, B: Bainite

Vα: Areal rate of ferrite phase, d: Average grain size of ferrite phase

Fatigue resistance = (Fatigue limit of strain aged steel) − (Fatigue limit of steel as hot-rolled)

Impact resistance = (Absorbed energy of strain aged steel) / (Absorbed energy of steel as hot-rolled)

En: Absorbed energy of strain aged steel, $\sigma_w$: Fatigue limit of strain aged steel Nb*: Amount of Nb precipitated as Nb carbonitride V*: Amount of V precipitated as V carbonitride dp: Average grain size of Nb carbonitride or V carbonitride (Average grain size of both Nb carbonitride and V carbonitride when Nb and V are added in combination)

The invention claimed is:

1. A method for producing a high tensile strength hot-rolled steel sheet having superior strain aging hardenability with a BH of 80 MPa or more, a ΔTS of 40 MPa or more, and a tensile strength of 440 MPa or more comprising the steps of:

heating a steel slab to 1,000° C. or more, the steel slab comprising: in percent by mass, 0.15% or less of C;

2.0% or less of Si;

3.0% or less of Mn;

0.08% or less of P;

0.02% or less of S;

0.02% or less of Al;

0.0050% to 0.0250% of N; and optionally further comprising at least one selected from the group consisting of the following Group a to Group d, the ratio N (mass %)/Al (mass %) being 0.3 or more:

Group a: 1.0% or less in total of at least one of Cu, Ni, Cr, and Mo

Group b: 0.1% or less in total of at least one of Nb, Ti, and V

Group c: 0.0030% or less of B

Group d: 0.0010% to 0.10% in total of at least one of Ca and REM;

rough-rolling the steel slab to form a sheet bar;

finish-rolling the sheet bar at a finishing temperature of 800° C. or more;

cooling at a cooling rate of 20° C./s or more within 0.5 second after the finish-rolling;

slow cooling for 1 to 5 seconds at a rate of 10° C./s or less in the temperature range of 700 to 800° C.;

cooling at a rate of 20° C./s or more; and coiling at a temperature of 450° C. or less.

2. The method according to claim 1, wherein Al is present in an amount of 0.001% to 0.02%.

* * * * *